US012435944B2

(12) United States Patent
Grace et al.

(10) Patent No.: US 12,435,944 B2
(45) Date of Patent: Oct. 7, 2025

(54) TUBULAR ARCHERY BOW RISER

(71) Applicant: Grace Engineering Corp., Memphis, MI (US)

(72) Inventors: Nathaniel E. Grace, Fort Gratiot, MI (US); Casey W. Carew, Shelby Township, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 19/073,655

(22) Filed: Mar. 7, 2025

(65) Prior Publication Data

US 2025/0207886 A1 Jun. 26, 2025

Related U.S. Application Data

(62) Division of application No. 18/383,316, filed on Oct. 24, 2023, now Pat. No. 12,264,893.

(Continued)

(51) Int. Cl.

| | |
|---|---|
| ***F41B 5/14*** | (2006.01) |
| ***F41B 5/00*** | (2006.01) |
| ***F41B 5/10*** | (2006.01) |

(52) U.S. Cl.

CPC ..... *F41B 5/10* (2013.01); *F41B 5/0031* (2013.01)

(58) Field of Classification Search

CPC .. F41B 5/00; F41B 5/0031; F41B 5/10; F41B 5/14; F41B 5/1403

(Continued)

(56) References Cited

U.S. PATENT DOCUMENTS 1,188,485 A * 6/1916 Pruyn ..... F16L 37/252 405/257
1,810,335 A * 6/1931 Barnhart ..... F41B 5/0073 124/23.1

(Continued)

FOREIGN PATENT DOCUMENTS

CN 113340151 A 9/2021

OTHER PUBLICATIONS

2013 Hoyt Carbon Element G3.

(Continued)

*Primary Examiner* — Alexander R Niconovich
(74) *Attorney, Agent, or Firm* — Warner Norcross + Judd LLP

(57) ABSTRACT

An archery bow is provided including opposing limbs and a riser. The riser can include a riser handle and one or more primary riser elongated elements extending away from the handle to respective limbs. The primary riser elongated elements can be straight, elongated round or other shaped tubes, rods or bars constructed optionally from a composite or other material. Vents can be included in ports of the riser to facilitate escape of air when riser elongated elements are installed in those ports. The riser can include one or more connector lugs disposed between tube portions to facilitate attachment of accessories to the elongated elements. The elongated elements can be bonded, adhered or otherwise fixed to the riser handle, struts, lugs and/or limb pockets, which can be constructed from a metal such as aluminum, titanium or an alloy, and which can handle significant moments and forces transferred via the elongated elements.

20 Claims, 18 Drawing Sheets

Related U.S. Application Data

(60) Provisional application No. 63/423,891, filed on Nov. 9, 2022.

(58) Field of Classification Search
USPC ..... 124/23.1, 25.6, 88
See application file for complete search history.

(56) References Cited

U.S. PATENT DOCUMENTS 1,853,294 A * 4/1932 Barnhart ..... F41B 5/0073 124/90
1,877,273 A * 9/1932 Cowdery ..... F41B 5/0026 124/23.1
2,000,832 A * 5/1935 Fisher ..... F41B 5/0026 124/23.1
2,186,386 A * 1/1940 Lowell ..... F42B 6/04 124/24.1
2,608,188 A * 8/1952 Howard ..... F41B 5/0073 124/22
3,055,353 A * 9/1962 Perrucci ..... F41B 5/0005 124/24.1
3,537,439 A * 11/1970 Joslin ..... F41B 5/0026 124/44.5
3,771,508 A * 11/1973 Black ..... F41B 5/0026 124/90
3,802,410 A * 4/1974 Palma ..... F41B 5/0073 124/88
3,834,368 A * 9/1974 Geiger ..... F41B 5/0005 124/20.3
4,458,657 A * 7/1984 Stockmar ..... F41B 5/105 124/17
5,099,819 A * 3/1992 Simonds ..... F41B 5/10 124/88
5,291,874 A * 3/1994 Harrison ..... F41B 5/0026 72/364
D378,228 S 2/1997 Kysilka
5,682,871 A * 11/1997 Walk ..... F41B 5/10 124/24.1
5,697,358 A * 12/1997 Campisi ..... F41B 5/0052 124/88
D389,552 S 1/1998 Fitzgerald, Jr.
D448,827 S 10/2001 Fitzgerald, Jr.
6,712,057 B2 * 3/2004 Andrews ..... F41B 5/0026 124/23.1
7,258,113 B2 * 8/2007 Pilpel ..... F41B 5/0042 124/88
8,079,353 B2 * 12/2011 Davis ..... F41B 5/0052 124/88
8,844,510 B2 * 9/2014 Liu ..... F41B 5/00 124/88
9,377,266 B2 * 6/2016 Derus ..... F41B 5/14
9,395,140 B2 * 7/2016 Ell ..... F41B 5/1403
10,126,091 B2 * 11/2018 Wendelburg ..... F41B 5/14
10,837,732 B2 * 11/2020 McPherson ..... F41B 5/105
12,264,893 B2 * 4/2025 Grace ..... F41B 5/10
2009/0050125 A1 2/2009 Davis et al.
2010/0313864 A1 * 12/2010 Gardner ..... F41B 5/10 124/1
2013/0112182 A1 * 5/2013 Martin ..... F41B 5/1403 124/23.1
2014/0123971 A1 5/2014 Liu
2015/0362281 A1 * 12/2015 Derus ..... F41B 5/1403 124/88
2018/0094897 A1 * 4/2018 Langley ..... F41B 5/10
2024/0093961 A1 * 3/2024 Ren ..... F41B 5/10

OTHER PUBLICATIONS

2013 Hoyt Carbon Element G3—Cut through grip handle showing continuous riser tubes extending above and below, and completely through the grip handle.
2006-2007 Lancaster Archery Supply Archer's Wish Book.
https://www.ebay.com/itm/177094339227?_skw=hoyt+carbon+element&itmmeta=01JY4P948XHQJJHDK4TDVKP5NM&hash=item293ba52a9b:g:Q~EAAeSwTB1n5ten&itmprp=enc%3AAQAKAAAA0MHg7L1Zz0LA5DYYmRTS301%2B9JRmoO25Bvb65S%2Ff1Hx398Zalc97cJEe6hu3e4IvRqSXxzTK3Iz91jo0WK7s7umqKn2wwnGErN7vkgMJdZbP5GTtfGGxsC21YqBn9s0tadtYWpItw%2BMVUW8zpZRNFjS3gNchqRXN88gHhaxwfM1rZk3ZfNt6Joy6vVbavbQmUOub6I3t2cFFpZft%2FXV2koiFWxXjDAZB0X31%2BIyzvCTqWkTz8p6F6u5tzzIANXaf2ldhwy%2BEu6ahgQfP5p9%2BH60%3D%7Ctkp%3ABk9SR8rEpJbxZQ, dated Jun. 19, 2025.

* cited by examiner

TUBULAR ARCHERY BOW RISER

BACKGROUND OF THE INVENTION

The present invention relates to archery bows, and more particularly to an archery bow riser constructed from tubes.

For centuries, archery bows were constructed entirely from wood. Such wooden bows typically included a bow handle, upper and lower resilient limbs extending from the handle, and a bowstring attached to the upper and lower bow limbs. As technology advanced, so too did the desire to increase the amount of energy stored in the bow limbs, and thus increase the force available to propel an arrow show from the bow. Accordingly, compound bows became prevalent because they could store significantly more energy in their bow limbs than simple, non-compound bows having long, more flexible limbs. However, the bending moments produced by the relatively wide bow limbs of compound bows are large. Thus, compound bows frequently require larger, more massive cast, forged or machined metal risers. Due to the metal construction and larger size, risers became heavier, which in turn has increased the overall weight of many compound bows. This of course can be less desirable for archers and bow hunters, who typically want bows that are both lightweight and portable, as well as fast shooting. The large risers also are complex and expensive to produce and ship due to their size, shape and weight, so they pose challenges to archery bow manufacturers.

As a result, some manufacturers have begun to produce complete archery bow risers from carbon and composites. These risers include complex structures of carbon plies and fixtures to attach the limbs. While in some cases these carbon risers reduce weight of the bows, in others they actually increase the weight due to the complicated structures used to form the bow handle and connect the limbs. Further, the manufacturing process to make such composite risers can be elaborate and time consuming, as well as labor intensive.

Accordingly, there remains room for improvement in the field of composite archery bows and risers, to reduce the weight of such bows and risers, to simplify manufacturing, and/or to reduce the cost of the same.

SUMMARY OF THE INVENTION

An archery bow and riser are provided including opposing limbs and a riser. The riser can include a riser handle, one or more riser elongated members extending from the handle toward respective limbs and one or more struts between the riser handle and a respective limb to capture and maintain the riser elongated members in a fixed orientation relative to one another and relative to limb pockets with which the limbs are mounted to the riser.

In one embodiment, the riser elongated members can include one or more riser tubes, for example, primary and secondary riser rubes. The one or more riser tubes can be elongated tubes constructed from a composite including high strength fibers such as graphite, glass, carbon and the like. In other constructions, the tubes can be metal, such as aluminum, titanium and/or an alloy. The tubes can be of a cylindrical, ellipitical or polygonal shape, and can be hollow from end to end. The tubes can have cross sections that are correspondingly circular, elliptical, polygonal, or combinations of the foregoing.

In another embodiment, the riser handle, struts and limb pockets, can be constructed from a metal such as aluminum, titanium or an alloy, and which can handle significant moments and forces transferred via the tubes therethrough. In other constructions, these components can be constructed from polymers or composites, such as carbon, carbon and metal and the like.

In still another embodiment, a first primary riser tube can be linear and straight, and can have a first linear axis. A secondary riser tube can be linear and straight, and can have a second linear axis transverse to the first linear axis and transverse to a bowstring plane in which a bowstring attached to the limbs moves. The second linear axis can be offset by a first angle that optionally is 1° to 45°, inclusive, relative to the first linear axis and/or the bowstring plane.

In yet another embodiment, the first secondary riser tube can be disposed between the riser handle and the first limb. The first strut can include a first primary riser tube port engaging the first primary riser tube, and a first secondary riser tube port engaging the first secondary riser tube. The primary and secondary riser tubes can extend away from the first strut toward the first limb.

In even another embodiment, the first strut can include multiple ports to accommodate a pair of primary riser tubes and a pair of secondary riser tubes. The primary riser tubes can extend through corresponding ports forming through holes in the strut, generally from the riser handle to a limb pocket. The ports for the primary riser tubes can be through holes, allowing the primary riser tubes to extend continuously through the strut, without interruption in the tube. The secondary riser tubes can extend out from corresponding ports, optionally formed as cups, defined by the strut to the limb pocket, traversing the bowstring plane in doing so. The secondary riser tubes might not extend through the first strut, and can terminate at respective ends disposed in a portion of the first strut.

In a further embodiment, the limb pocket can include limb pocket ports as well. These ports can face toward corresponding ports on the strut, which can be located between the limb pocket and the riser handle. The ports can be in the form of limb pocket cups, and can receive the ends of respective primary riser tubes and secondary riser tubes. The limb pockets can include limb recesses that receive the respective limbs of the bow.

In another embodiment, the riser can include one or more upper primary riser elongated elements, and one or more lower primary riser elongated elements. The elongated elements can be in the form of tubes that are hollow and/or bars or rods that are solid. The riser can include a handle from which the upper primary riser tubes extend upward, and from which the lower primary riser elongated elements extend downward. The upper and lower elongated elements can include the above noted shapes including, but not limited to, a cylindrical shape, as well as respective upper primary elongated element linear axes and lower primary elongated element linear axes.

In still another embodiment, an upper primary tube linear axes and a lower primary tube linear axes can be offset laterally from one another when viewing the riser from a front or rear view. For example, a lower primary tube linear axis can lay within and/or parallel to a bowstring plane of the archery bow. The upper primary tube linear axis, however, can be offset by a distance laterally from the lower primary tube linear axis. The upper primary tube linear axis thus also can be offset by that distance or close to it from the bowstring plane. The distance can vary depending on the configuration of the riser, the handle and the tubes.

In yet another embodiment, the handle can include upper ports or upper male connectors, and lower ports or lower male connectors. The upper primary tubes can be connected to the handle via the upper ports and the lower primary tubes can be connected to the handle via the lower ports. The upper and lower ports can be offset laterally from one another to provide the offset of the upper primary tube linear axis by the distance laterally from the lower primary tube linear axis.

In even another embodiment, the riser can include an upper limb strut and a lower limb strut. The upper limb strut can be joined atop the upper primary tubes and the lower limb strut can be joined below the lower primary tubes. Respective upper and lower limbs can be joined with the upper limb strut and the lower limb strut.

In a further embodiment, the upper limb strut can include an upper strut connector, a transition element above that strut connector, and a limb connector above the transition element. The limb connector can be offset from the upper primary tube linear axis by the distance mentioned above. The transition element can be homogeneous and integral with the strut connector and the limb connector, but can be optionally bent, angled curved or offset away from the strut connector toward the bowstring plane.

In still a further embodiment, the riser can include a lug, strut, handle or other element that defines a port configured to receive a tube, such as a primary riser tube, secondary riser tube, or tube portion. A vent can be in fluid communication with the port and an exterior surface of the lug, strut, handle or other element so that any fluid within the port can be evacuated, dispensed or moved from the port to the environmental exterior to the lug, strut, handle or other element. The vent thus can evacuate air from the port and from between the tube and a sidewall of the port so the air is not trapped therebetween, which may create poor adhesion. In some cases, adhesive may also evacuate from the port through the vent when excessive, to improve bonding between the port and tube with the adhesive.

In yet a further embodiment, the lug, the strut, the handle and/or the tube can define a vent extending from a gap between the tube and a port defined by the lug or strut. The vent can allow air to evacuate from the gap when an adhesive is introduced or applied in that gap. In this case, the pressure of air inside the tube and/or the port is reduced and/or the air can escape from the gap without pushing the adhesive out of the gap excessively or at all in some cases.

In even a further embodiment, the ports can include a mechanical lock to enhance or improve the securement of a tube within a port defined by a lug, strut, handle or other element of the riser. The mechanical lock can be grooves, threading, holes, recesses, knurling or mass reducing feature defined by a sidewall of the port and/or the sidewall of the tube that faces the sidewall of the port. An adhesive, glue or other bonding agent can extend or flow into or within the mechanical lock to enhance the bonding and securement of the tube within the port via that adhesive when it cures.

The current embodiments provide an archery bow and riser that is lightweight, rigid and mechanically strengthened to resist dynamic moments and forces exerted on the bow when shot. Where the riser includes tubes, those tubes can be cylindrical and easily and consistently manufactured. In some cases, the tubes can be cut to custom lengths to fit the size of a user, and/or provide a particular axle to axle length and/or draw length of the user. The tubes can be assembled with the riser handle, lugs, struts and limb pockets quickly, efficiently and consistently.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
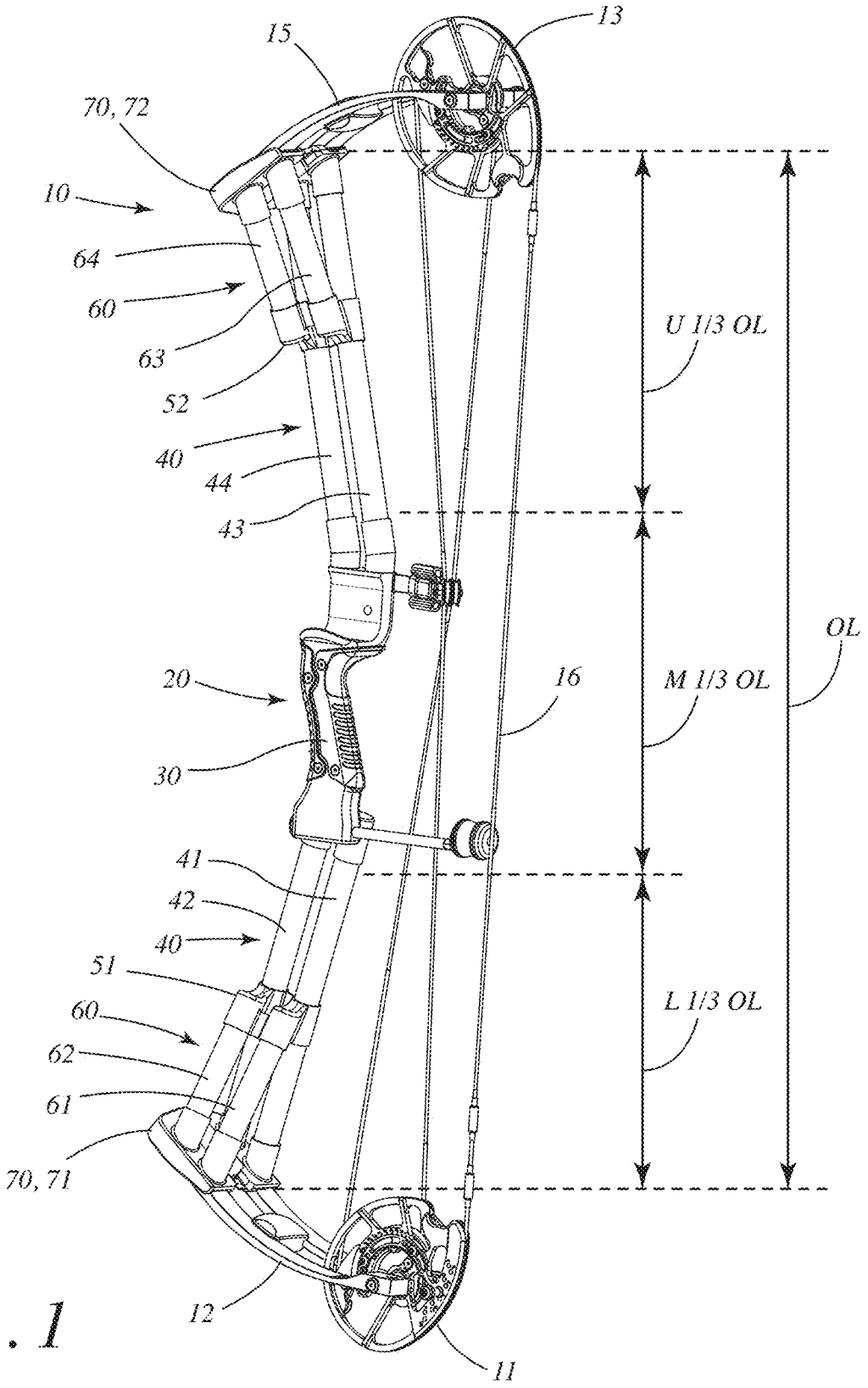
FIG. 1 is a rear perspective view of the archery bow of a current embodiment.

A current embodiment of the archery bow is shown in FIGS. 1-6 and generally designated 10. The archery bow 10 is shown as a compound bow, and can include a first or lower cam 11 and a second or upper cam 13, which can form a dual cam system on the bow 10. The lower cam 11 can be mounted to a first limb 12 which can be a lower limb, and the upper cam 13 can be mounted to a second limb 15 which can be an upper limb of the bow 10. The upper and lower limbs can be joined with the riser 20 of the bow, and spaced apart from one another in a desired configuration. In the current embodiment of a dual cam bow, the upper and lower cams can include generally the same components, and can operate in a similar manner. A bowstring 16 can extend between the first and second limbs, and between the respective first and second cams. The bowstring can move within a bowstring plane P1 (FIGS. 2, 4) when drawn or shot, which plane P1 can correspond to a centerline of the bow 10.

Although the current embodiment of FIGS. 1-6 is described in connection with a dual cam bow, the cams, bowstring, cables and other features are suited for use with simpler pulley systems, for example, in single cam, cam and a half, and single cam systems as well. Further, the embodiments herein are well suited for cam assemblies of single cam compound archery bows, dual cam bows, cam and a half bows, crossbows and other archery systems including a cam and/or a pulley.

As used herein, a "cam" refers to a cam, a pulley, and/or an eccentric, whether a modular, removable part, or an integral part of a cam, for use with an archery bow. As used herein, "inhibit" refers to preventing, impairing and/or reducing a certain event, action, result, force, torque, twist and/or activity. As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam, and can be of virtually any geometric cross section, for example, partially or fully semi-circular, rounded, triangular, rectangular, square, polygonal, or combinations of the foregoing.

As used herein, an "axis of rotation", "first axis of rotation" or "second axis of rotation refers to an axis about which a cam can and/or does rotate, for example, a first axis AX1 or second axis AX2. These axes can coincide with the center of the axles and that mount the respective cams 11 and 13 to the first limb 12 and second limb 15. Optionally, the axle and/or limb can include suitable bearings to enhance rotation of the cams. Suitable bearings include, but are not limited to, bushings, roller bearings, and ball bearings.

Although not described in detail, the cams herein can include modular elements that provide some level of adjustment of a performance characteristic of a bow, including but not limited to, a particular draw length, draw stop or draw force for the bow. The cams can have secured thereto draw stops, anchors, bearings and other components. The cam components herein can be joined with one another via fasteners such as screws, rivets, welds, and other fastening structures. Alternatively, the cam components can be in the form of a monolithic, continuous single piece structure that includes the cam components and the respective features thereof.

The riser 20 of the archery bow 10 will now be described in more detail. Generally, the riser 10 can include a riser handle 30 from which one or more primary riser tubes 40 originate and extend away from, one or more struts 50 from which one or more secondary riser tubes 60 originate and extend from, and one or more limb pockets 70, at which the primary riser tubes 40 and secondary riser tubes 60 terminate or end.

Optionally, in any of the embodiments herein, riser tubes can be straight, elongated, linear tubes constructed from a composite including high strength fibers, pieces or units such as graphite, glass, carbon and the like, or optionally metal, such as aluminum, titanium, steel, or any alloy. When constructed of such composite materials, the tubes can be referred to as being formed or constructed from a carbon composite. Carbon composite tubes can be formed via prepreg roll wrapping, filament winding, braided sleeve forming, bladder molding, compression molding, split molding, vacuum infusion and/or autoclave processing. Metal tubes can be extruded, pultruded, hydro formed, machined, and/or rolled and welded.

Figure 5:
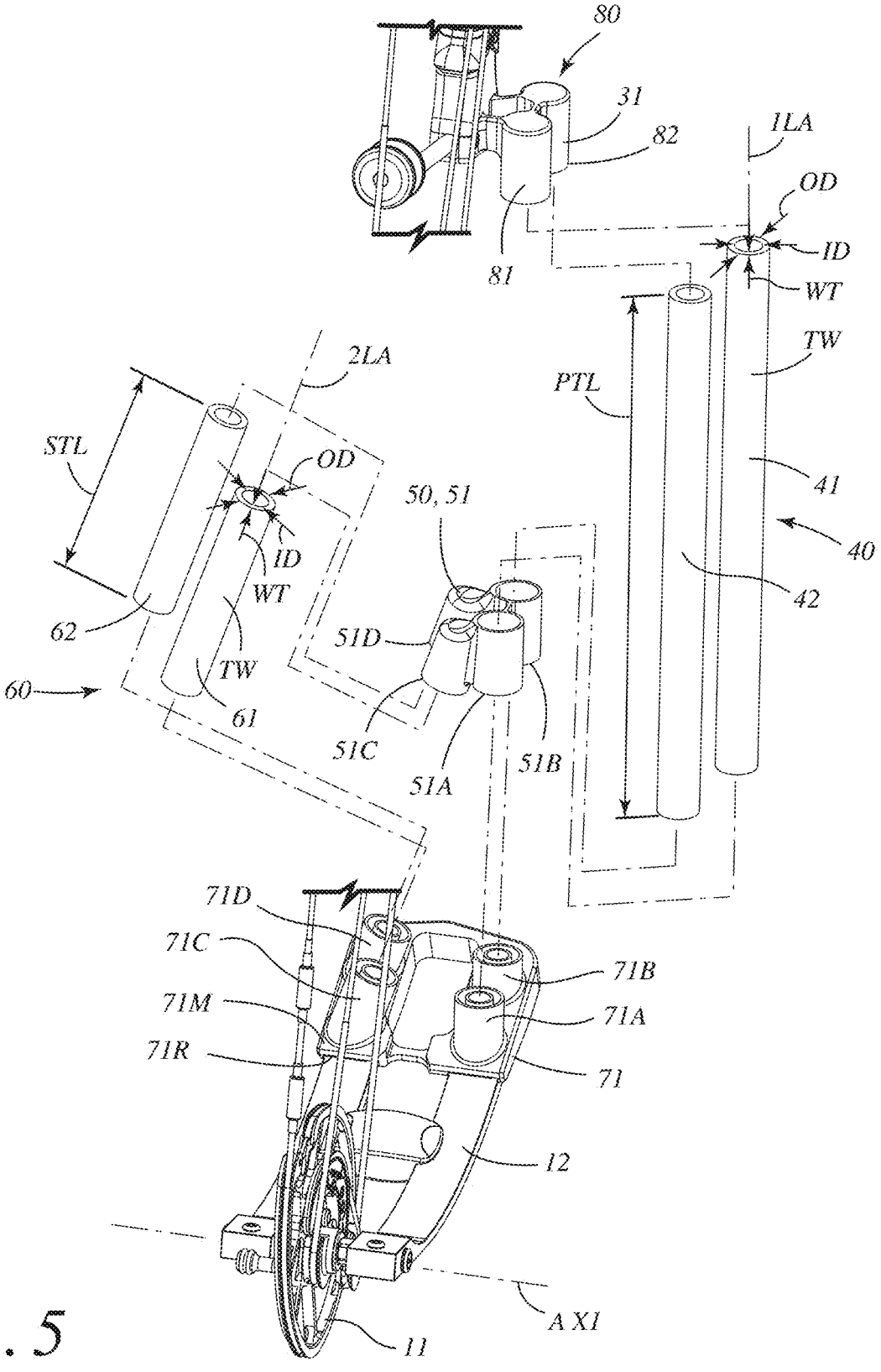
FIG. 5 is an exploded partial section view of a riser handle and primary riser tubes of the archery bow.
Figure 6:
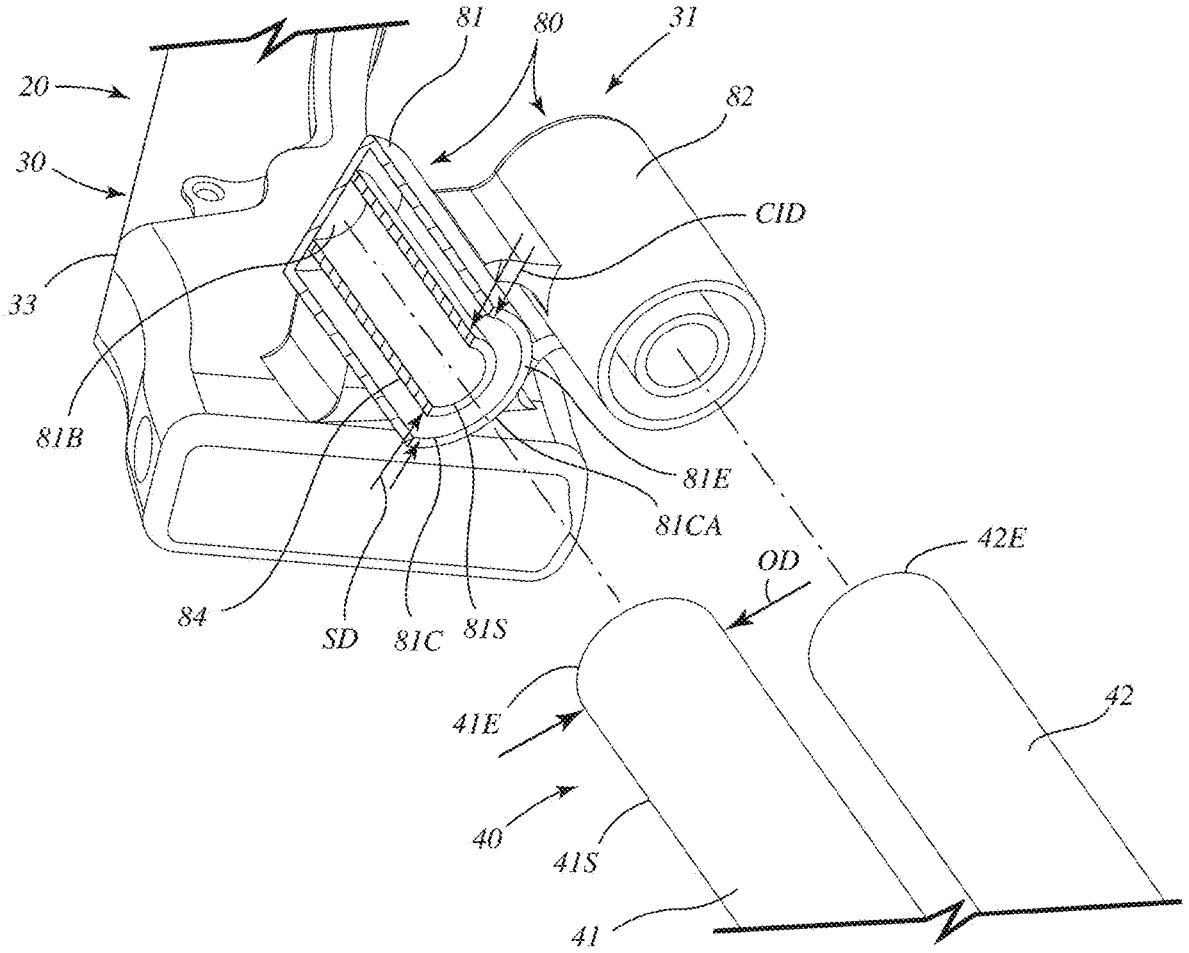
FIG. 6 is an exploded view of part of the riser.
Figure 7:
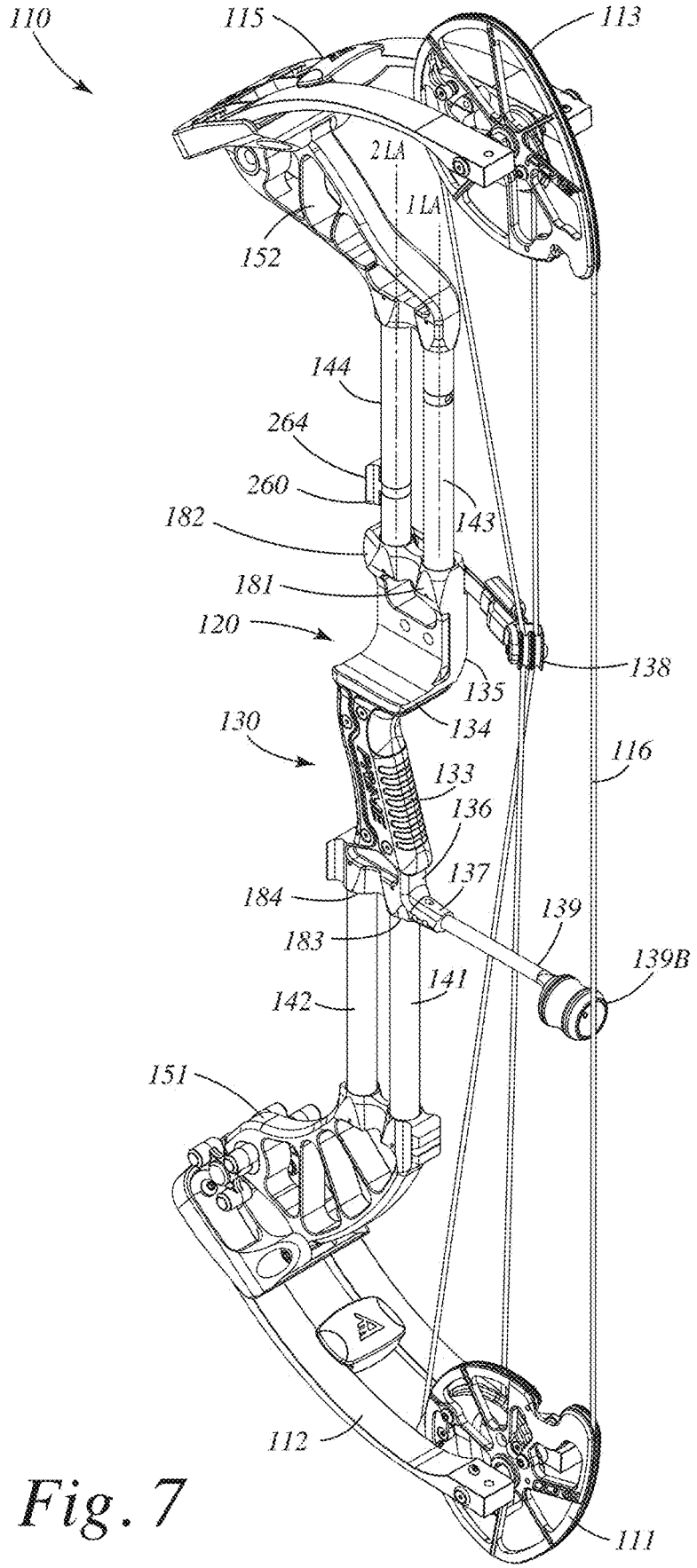
FIG. 7 is a rear perspective view of a first alternative embodiment of an archery bow.

As shown, in FIG. 5-7, the primary 40 and secondary 60 tubes can be of a cylindrical or polygonal shape, and can be hollow from end to end. The tubes can handle significant forces transferred through the sidewalls in a generally linear manner. Each of the tubes can include an inner dimension ID and an outer dimension OD. Where the tubes have a circular cross-section as shown, the inner dimension can be an inner diameter ID and the outer dimension OD can be an outer diameter OD. Optionally, the inner diameter and outer diameter of each of the primary tubes 40 and secondary tubes 60 can be identical. These inner and outer diameters can be consistent and unchanging from one end of each of the primary riser tubes 40 and secondary riser tubes 60 to another end. The wall thickness WT between the inner diameter ID and the outer diameter OD also can be consistent and uniform throughout the overall length of each of the respective tubes. Optionally, the wall thickness WT can vary from one end of a tube to the other. Likewise, the inner diameter ID and/or outer diameter OD also can vary. In some cases, the tubes can be slightly tapered from one end to the other, changing from a greater outer diameter to a lesser outer diameter from one end to another. This can vary depending on the application and the availability of tube stock for use in constructing the respective primary and secondary riser tubes.

As mentioned above, the tubes 40 and 60 can be hollow from one end to another. Each tube can be bounded by a tube wall TW which can generally circumferentiate a linear axis of the respective tube. For example, as shown in FIG. 5, a first primary riser tube 41 and a first secondary riser tube 61 are illustrated with respective first linear axis 1LA and second linear axis 2LA. These linear axes can correspond to the centers of the tubes, generally forming longitudinal axes of the respective tubes. As mentioned above, the linear axes 1LA and 2LA can be substantially straight as shown, however, where the respective primary riser tube and secondary riser tube have any curve or contour to them, these axes can be nonlinear and/or curved.

As shown in FIG. 5, the primary riser tubes 40 and secondary riser tubes 60 can have different lengths. For example, the primary riser tubes 40 can include a primary tube length PTL and the secondary riser tubes 60 can include a secondary tube length STL. The primary tube length PTL can be greater than the secondary tube length STL. In other applications, depending on the configuration of the riser and the bow, these lengths can be reversed or equal in some cases. Further, the lengths of the primary riser tubes 40 above the riser handle 30 and below the riser handle 30 can be equal, but of course, can vary depending on the application. Further, the lengths of the secondary riser tubes 60 above the riser handle 30 and below the riser handle 30 can be equal, but of course can vary depending on the application as well. In some cases, these consistent lengths of the respective tubes above and below the riser handle 30 can simplify manufacture and assembly of the riser. For example, initially, the tubes can come in stock, uncut lengths. Those stock tubes can be cut to the primary tube length PTL and the secondary tube length STL. From there, an assembler can assemble those respective tubes relative to the riser handle 30, struts 50 and limb pockets 70 respectively, without having to custom cut any particular length of any primary or secondary riser tube.

The primary riser tubes 40 and secondary riser tubes 60 optionally can come in respective upper and lower pairs. For example, lower first and second primary riser tubes 41 and 42 can be disposed below the riser handle 30, while upper third 43 and fourth 44 primary riser tubes can be disposed above the riser handle 30. Likewise, lower first secondary riser tube 61 and second secondary riser tubes 62 can be disposed below the riser handle 30 and below the first strut 51, generally between that strut 51 and the first limb pocket 71. The upper third secondary riser tube 63 and fourth secondary upper riser tube 64 can be disposed above the riser handle 30 and above the second strut 52, generally between that strut 52 and the second limb pocket 72.

Figure 2:
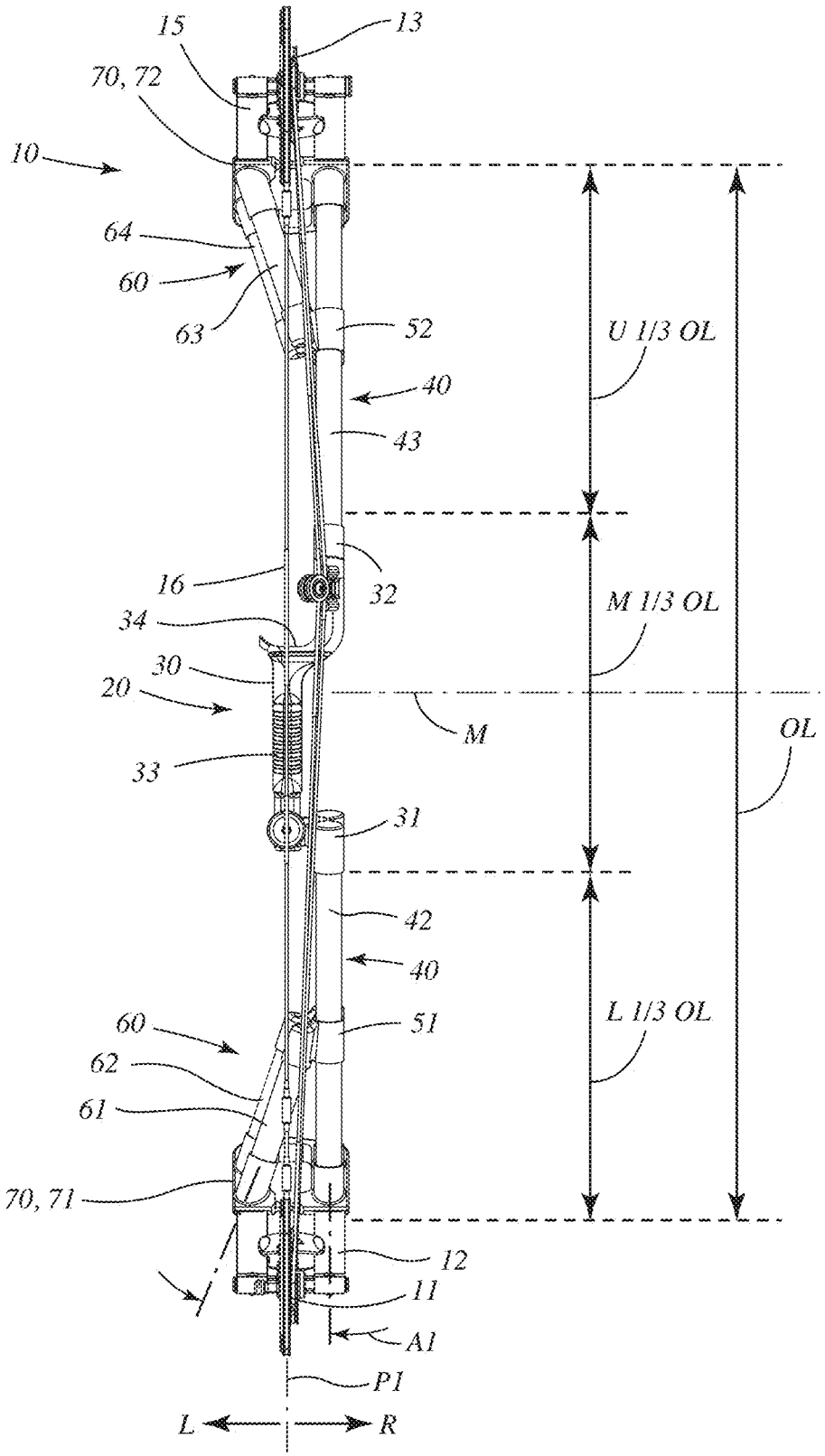
FIG. 2 is a rear view of the archery bow.
Figure 3:
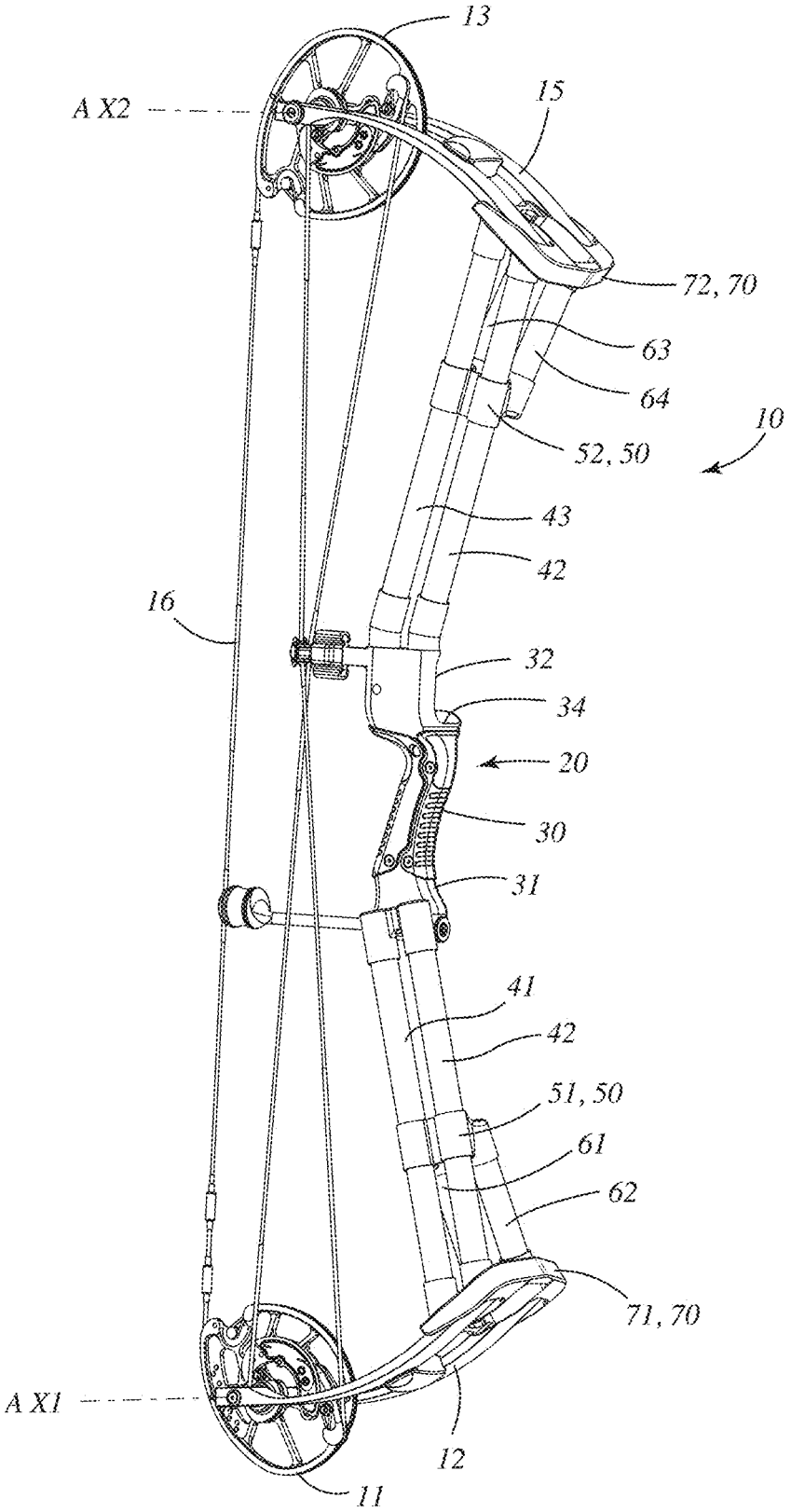
FIG. 3 is a front perspective view of the archery bow.

With the reference to FIGS. 1 and 2, the first 41 and second 42 primary riser tubes can be disposed in a lower portion of the overall length OL of the riser 20. For example, the first and second primary riser tubes 41 and 42 can be disposed in the lower L1/3OL length of the overall length OL. Likewise the first 61 and second 62 secondary riser tubes can be disposed in that lower L1/3OL of the overall length OL of the riser. In different applications, these tubes can be disposed in the lower ⅛, ¼, or ½ of the overall length OL. As shown however, the primary riser tubes 41 and 42 originate at the lower riser strut 31 and extend downward from the riser handle 30 and the grip 33 of the handle where user grips the bow. The grip 33 can be disposed below a shelf 34 of the riser handle 30 and further below the upper or second strut 32 of the riser handle 30. The primary riser tubes 41 and 42 can terminate at the first or lower riser strut 31 without extending upward beyond the grip 23 and/or the shelf 24. In this case, the first and second primary riser tubes 41, 42 are isolated to the portion of the riser 20 below the riser handle 30 and below the grip 33 of the handle. Optionally, nothing but the grip 33 and/or the riser handle 30 connects the first and second primary riser tubes 41, 42 to the third and fourth 43, 44 primary riser tubes extending upward and above the shelf 34 of the riser handle 33. As shown, none of the lower primary riser tubes 41, 42 or lower secondary riser tubes 61, 62 extend upward beyond the middle M of the riser 20 or generally of the overall length OL. Likewise, none of the upper primary riser tubes 43, 44 or upper secondary riser tubes 63, 64 extend downward beyond the middle M of the overall length OL. Further, none of the primary riser tubes extend continuously or completely from the first limb pocket 71 to the second limb pocket 72 supporting the respective first 12 and second 15 limbs. Further as shown, the riser handle 30 optionally can be the only structure connecting the lower primary riser tubes 41 and 42 and the upper primary riser tubes 43 and 44.

Figure 4:
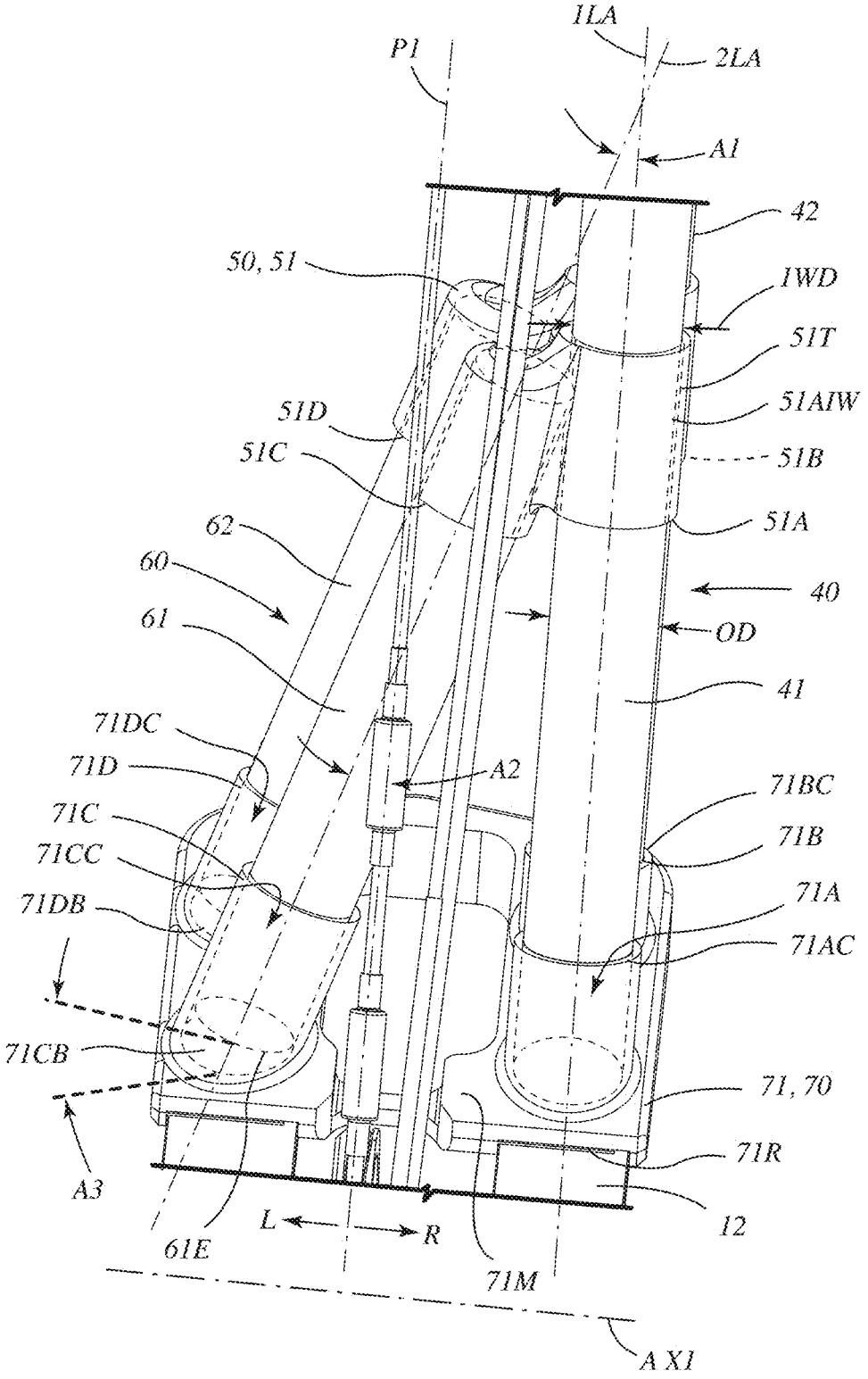
FIG. 4 is a rear view of a strut and a limb pocket of a riser of the archery bow.

With reference to FIGS. 2 and 4-6, the orientations of the primary riser tubes and secondary riser tubes will now be described in further detail. As mentioned above, the primary riser tubes, for example, the first 41 and second 42 primary riser tubes can extend downward from the riser handle 30. These tubes can extend continuously and uninterrupted to the first limb pocket 71. As mentioned above, however, the secondary riser tubes 61 and 62 can be shorter than the primary riser tubes 41 and 42, and can originate at the first strut 51 extending downward to the first limb pocket 71. As shown in FIGS. 2 and 4, the first secondary riser tube 61 can be offset and transverse relative to the first primary riser tube 41. In particular, the first riser tube 41 can include a first linear axis 1LA. The first secondary tube 61 can include a second linear axis 2LA. These axes can be offset at an angle A1 relative to one another. As a result, the respective primary and secondary tubes also are offset at that angle. This angle A1 can be optionally 1° to 60° inclusive, 1° to 45° inclusive, 1° to 40° inclusive, 1° to 35°, inclusive, 1° to 30°, inclusive, 1° to 25° inclusive, 1° to 20° inclusive, 1° to 15° inclusive, 1° to 10° inclusive, 1° to 5° inclusive, or other angles depending on the tubes and configuration of the riser and limb pocket.

As further illustrated in FIG. 4, the first secondary riser tube 61 and second secondary riser tube 62 can be offset or transverse relative to the bowstring plane P1. In particular, the second linear axis 2LA of the first secondary riser tube 61 can be offset at an angle A2 relative to the bowstring plane P1. This angle A2 can be optionally the same angle as A2 as noted above, or other angles depending on the tubes and location or orientation of the bowstring plane P1. As will be appreciated, the second secondary riser tube 62 likewise can be offset at the same angle A2 with its linear axis LA at the same angle A2 relative to the bowstring plane P1. With this type of offset, transverse orientation of the secondary riser tubes 61 and 62 relative to the bowstring 16 and the bowstring plane P1, it can be seen that both the upper 61, 62 and lower 63, 64 secondary riser tubes can intersect and/or pass through the bowstring plane P1, passing from one side R to another opposing side L of that bowstring plane P1. Optionally, the primary riser tubes 40, including both the lower 41, 42 and upper 43, 44 primary riser tubes, can remain substantially entirely on the same side R of the bowstring plane P1 without passing to the left side L. It will be appreciated that the third 43 and fourth 44 primary riser tubes can be similarly situated and oriented relative to the bowstring plane P1, the riser handle 30, and the respective third 63 and fourth 64 secondary riser tubes. Likewise, the respective axes of the primary riser tubes 43, 44 can be offset angled or otherwise transverse relative to the linear axes of the respective third 63 and fourth 64 secondary riser tubes as they transition to the second limb pocket 72.

Optionally, the various primary riser tubes 40 can be parallel to one another and transverse to the respective secondary riser tubes 60. The secondary riser tubes 60 also can be parallel to one another and offset at angles relative to the primary riser tubes 49 as described herein. Further optionally, each of the linear axes 1LA and 2LA of the respective primary riser tubes and secondary riser tubes can correspond to cup axes of the respective cups of the ports 51A-51D in the strut 51. For example, the first port 51A can include a cup axis that corresponds to the first linear axis 1LA. The port 51C can include a cup axis that corresponds to the second linear axis 2LA. The first and second cup axes can be offset from one another by the first angle A1 as described above. The respective cup axis of the port 51C also can be offset relative to the bowstring plane P1 at the angle A2 as described above.

The riser handle 33 can connect the upper and lower primary riser tubes. The riser handle as mentioned can include the respective first riser strut 31 and second riser strut 32. The first or lower riser strut 31 can extend downward, below the handle 33. The second or upper strut riser strut 32 can extend upward away from the ship shelf 34. Each of these struts can be similar and can include respective ports that receive and/or engage the respective upper and lower primary riser tubes. For purposes herein, the first strut 31 will be described, and it will be appreciated that the ports of this riser strut 31 can be identical to all of the other ports of all other components of the riser, such as the ports of the first strut 51, second strut 52, second riser strut 32, and limb pockets 71, 72. Therefore, each of the other respective ports for other elements will not be described again in substantial detail.

With reference to FIG. 5-6, the riser strut 31 can include one or more riser ports 80, such as a first primary riser handle port 81 and a second primary riser handle port 82. The first riser port 81 can be configured to receive and engage the first primary riser tube 41, while the second riser port 82 can be configured to receive and engage the second prior riser tube 42. The first riser port 81 can be in the form of a cup 81C defined by a sidewall 81S extending around a cup axis 81CA. The cup sidewall 81S can include an inner diameter CID that is greater than the outer diameter OD of the of the first riser tube 41. This can enable the first riser tube end 41E to be inserted into the cup 81C. The port 81 also can include a lower wall or bottom wall 81B. This bottom wall 81B can prevent the first primary riser tube 41 from extending through the port 81. In this manner, when installed, the first primary riser tube 41 can be inserted into the cup 81C and can be placed adjacent or engaging the bottom wall 81B. The first primary riser tube 41 can project into the cup 81C and can have its end 41E in a position adjacent the bottom wall. The first primary riser tube 41 can terminate at the bottom wall or generally at the riser handle or within the port 81. With its first end 41E sufficiently inserted into the cup 81C, the sidewall 81S can be adjacent, contacting and/or engaging the exterior surface 41S of the first primary riser tube 41. In some cases, the riser tube 41 can be friction fit into the cup 81C. It can slide along and frictionally engage the sidewall 81S of the cup 81C when being installed. To further secure the first primary riser tube 41 relative to the port 81, an adhesive, glue, cement or other chemical agent can be disposed between the sidewall 81S and exterior surface 41S or other surface of the riser tube 41. In alternative constructions not shown, a fastener, peg, pin or other element can be installed through apertures holes or recesses defined by the port 81 and can engage the riser tube 41, optionally extending through its sidewall and or other components thereof. In further alternative constructions, the end 41E can include projections, such as ridges, while the port 81 and the cup 81C can be constructed with corresponding recesses, such as grooves, which can receive the projections or ridges of the tube 41. These elements can be reversed to provide interlocking between the port 81 and the riser tube 41. In yet further alternative constructions, the port 81 can be outfitted with a lever and a cam which can extend into the cup 81C. The lever can be actuated to move the cam against the riser tube 41 and lock the riser tube relative to the port 81. A variety of other locking mechanisms can be used to secure the riser tube 41 within the port 81. Of course, any of the above securing materials and mechanisms can be used to secure any tube of the riser relative to any port of the riser.

As also shown in FIG. 6, an optional support tube 84 can extend from the bottom wall 81B coaxially within the port. The support tube 84 can fit within a bore of the first primary riser tube 41. The support tube 84 can include a support tube diameter SD that is smaller than an inner diameter ID of the riser tube 41 to provide this fitment. Optionally, the support tube 84 can be secured to the interior of the sidewall of the riser tube 41 with adhesive, glue, cement, fasteners etc., as described above. As shown, the support tube 84 does not extend beyond the outer edge 81E of the cup 81C. Of course, in other applications, the support tube 84 can be shorter than that shown, or can optionally extend beyond the edge 81E.

Further optionally, although not shown, the outer sidewall 81S of the port 81 can be deleted. In this case, the support tube 84 can extend into the riser tube 41 and can provide the support and connection of that riser tube 41 to the port 81. Any of the ports described herein can form cups into which the ends of the respective tubes are inserted and secured, or can form support tubes that extend into or are inserted into the respective tubes, and/or a combination of these or other features to secure the tubes to the respective ports.

The features of the riser other than the primary riser tubes and secondary riser tubes, such as the riser handle 30, struts 50 and limb pockets 70 can be constructed from metals, such as titanium, aluminum, steel or other alloys and the like. These components can be CNC machined, molded and/or printed from the respective materials. In some cases, the riser handle, struts and other components can be hollow to reduce weight. Optionally, these components can be 3D printed from a metal, such as titanium, or some other deposition metal, which can assist in forming the aforementioned hollow features.

As mentioned above, the riser 20 can include struts 50, which can include a first strut 51 and a second strut 52. The first strut 51 can be disposed below the riser handle 30 while the second strut 52 can be disposed above the riser handle 30. The first strut 51 and second strut 52 can be substantially identical so only the first strut 51 will be described here with reference to FIGS. 4-6. The first strut 51 can be disposed between the riser handle 30 and the first limb 12 which again can be the lower limb of the bow 10. The first strut 51 can be disposed in the lower third of the overall length L1/3OL, and generally below the riser handle, but above the limb pocket 71. The first strut 51 can include multiple ports 51A-51D, which can be configured to receive, contact or otherwise engage the respective primary riser tubes 41, 42 and secondary riser tubes 61 and 62. For example, the first strut 51 can include a first primary riser port tube 51A that is configured to engage the first primary riser tube 41, along with a first secondary riser tube port 51B that is configured to engage the first secondary riser tube 61. The ports 51C and 51D can be substantially identical to the riser ports 80 as described above, and can incorporate the same features or modifications of the same depending on the application.

As shown in FIGS. 4-5, the ports 51A and 51B however can be different from the ports 51C and 51D. For example, the ports 51A and 51B can be complete through holes through which the first primary riser tube 41 and second primary riser tube 42 completely extend. These ports 51A and 51B can include an inner cylindrical wall that can receive the riser tubes there through. The first primary riser tube port 51A of the first strut 51 can include an inner wall 51AIW. This inner wall 51AIW shown in FIG. 4 can include a diameter IWD that is greater than the outer diameter OD of the first primary riser tube 41. Thus, the primary riser tube can extend through the through hole 51T of that port 51A. Optionally, glue, cement, adhesive or other chemicals can be disposed between the exterior surface of the tube 41 and the inner wall 51AIW to secure the strut 51 relative to the riser tube 41 in a fixed orientation. Alternatively, fasteners or other bonding materials or mechanisms as described herein can be used to secure those elements together. Of course in some applications, the riser tubes 40 can be unsecured within the through hole 51T and can free float relative to the struts 50. In other cases, the riser tubes 40 can be friction fit tightly within the through holes and thus within the respective ports to prevent excessive movement.

The respective ports 51A-51D of the first strut 51 can be arranged and oriented relative to one another such that the respective primary riser tubes 40 and secondary riser tube 60 extend away from that unit along the respective linear axes 1LA and 2LA and are oriented relative to one another and to the plane P1 at the respective angles A1 and A2 as described above. The first strut 51 the respective ports 51A-51D also can align the primary riser tubes and the secondary riser tubes so they extend independently away from the first strut 51 toward the first limb 12. The ports can align the respective tubes so that the primary riser tubes and secondary riser tubes extend independently away from one another respectively. As will be appreciated, the second strut 52 in the upper portion of the riser 20 can similarly orient the third 43 and fourth 44 primary riser tubes as well as the third 63 and fourth 64 secondary riser tubes relative to the limb pockets and other elements.

As mentioned above, the riser 20 can include limb pockets 70. The limb pockets can include a first limb pocket 71 and a second limb pocket 72 associated with the respective limbs 12 and 15. The first limb pocket 71 will only be described here, with the understanding that the second limb pocket 72 can be substantially identical but disposed on the upper portion of the riser. The first limb pocket 71 can receive a proximal end of the first limb 12. The limb pocket 71 can include a recess 71R that specifically receives one or more limb portions of the limb 12 which can be secured therein using conventional fasteners or securing mechanisms. The first limb pocket 71 can include a first mounting surface 71M opposite the first limb recess 71R. The first mounting surface 71M can include first and second primary riser ports 71A, 71B that receive and engage the respective primary riser tubes 41 and 42. Where those pocket riser ports 71A and 71B are in the form of the ports 80 described above, the first and second primary riser tubes 41 and 42 can project into the respective cups 71AC and 71BC of the those respective ports. The primary riser tubes 41, 42 can extend downward to bottoms of those cups and can engage any respective optional support tubes disposed in the ports as well. The riser tubes 41 and 42 can extend from a first end thereof located within the respective ports 71A and 71B to a second end 41E, 42E located in the riser ports 81 and 82 associated with the riser handle 30 and can terminate there.

The first strut 71 also can include ports 71C and 71D which can include respective cups 71CC and 71DC in which the secondary riser tubes 61 and 62 can project respectively. These tubes can extend downward to the bottom wall of those cups. For example, the first secondary port cup 71CC can be bounded by bottom wall 71CB. That bottom wall 71CB can be coplanar with the mounting surface 71M. The end 61E of the first secondary riser tube 61 can be generally flat and orthogonal to the second linear axis 2LA of that tube. Accordingly, when the secondary riser tube 61 is inserted into the port 71C and the respective cup 71CC, that end 61E is disposed at an angle A3 relative to the bottom 71CB of the cup. This angle A3 can be optionally 0°, 1° to 60°, inclusive, 1° to 45°, inclusive, 1° to 30° inclusive, 1° to 15° inclusive, 1° to 10° inclusive, or other angles depending on the application and configuration of the respective limb pocket ports 71C and 71D. As will be appreciated, the second limb pocket 72 can be configured with similar ports that interact with the respective primary riser tubes 41, 42 and secondary riser tube 63 and 64 above the riser handle 30.

A first alternative embodiment of the archery bow is shown in FIGS. 7-10, 13-14, 17-19 and 21-22 and generally designated 110. The archery bow 110 is shown as a compound bow, and can be similar or identical in structure, function and operation to the bow 10 of the current embodiment with several exceptions. For example, the bow 110 can include a first or upper cam 113 mounted on an upper or first limb 115 and a lower or second cam 111 mounted on a lower or second limb 112. The first limb 115 and a second limb 112 can be joined with a riser 120. A bowstring 116 can be configured to move, be drawn and released in a bowstring plane P1 similar to that above. The cams, limbs and other features also can be similar to the current embodiment above, and therefore will not be described in detail here again.

In this embodiment, the riser 120 can be constructed slightly differently. The riser 120 can include a riser handle 130. The riser handle 130 can be constructed so that a first upper primary riser tube 143 and a second first upper primary riser tube 144 extend upward from the handle 130. The handle 130 also can be constructed so that a first lower primary riser tube 141 and a second lower primary riser tube 142 extend downward from the handle. The upper and lower tubes can extend respectively toward the respective upper 115 and lower 112 limbs. The riser 130 can further include an upper strut or lug 152 and a lower lug or strut 151. The upper strut 152 can be joined with the upper ends of the first and second upper tubes 143 and 144, as well as a limb pocket and/or upper limb. The lower strut 151 can be joined with the lower ends of the first and second lower tubes 141 and 142, as well as a limb pocket and/or the lower limb. The struts can each include or define respective limb pockets that can be secured to or otherwise capture, hold or retain the respective limbs 115 and 112.

The primary tubes, riser handle and struts will now be described in further detail. To begin, the primary tubes can be straight, elongated, linear tubes constructed from a composite including high strength fibers, pieces or units such as graphite, glass, carbon and the like. When so constructed of such materials, the tubes can be referred to as being formed or constructed from a carbon composite. These tubes of course can alternatively be manufactured from metal, such as aluminum, titanium, steel or other materials. Optionally, the tubes can be hydroformed aluminum with non-circular shapes and different cross sections throughout the tube. The tubes can be composite tubes made of any materials, of any shape, with differing cross sections. The tubes can be tapered or barrel shaped. When referred to as straight, the tubes can include sidewalls or a sidewall that is parallel to a linear axis, generally without the sidewalls curving or rounding away from or deviating in distance from the linear axis. Like the embodiment above, the primary tubes can be of a cylindrical, elliptical or polygonal shape, and can be hollow from end to end. The tubes can handle significant forces transferred through the sidewalls thereof in a generally linear manner.

Optionally, like the embodiment above, each of the tubes can include an inner dimension and an outer dimension. Where the tubes have a circular cross-section, the inner dimension can be an inner diameter and the outer dimension can be an outer diameter as explained in connection with the embodiment above. The inner diameter and outer diameter of each of the primary tubes 141, 142, 143, 144 can be identical. These inner and outer diameters can be consistent and unchanging from one end of each of the primary riser tubes to an opposite end. A wall thickness between the inner diameter and the outer diameter can be consistent and uniform throughout the overall length of each of the respective tubes, or alternatively can vary. In some cases, the inner diameter and/or outer diameter also can vary, with the tubes slightly tapered or undulating from one end to the other, changing from a greater outer diameter to a lesser outer diameter from one end to another. This can vary depending on the application and the availability of tube stock for use in constructing the respective primary and secondary riser tubes.

Figure 8:
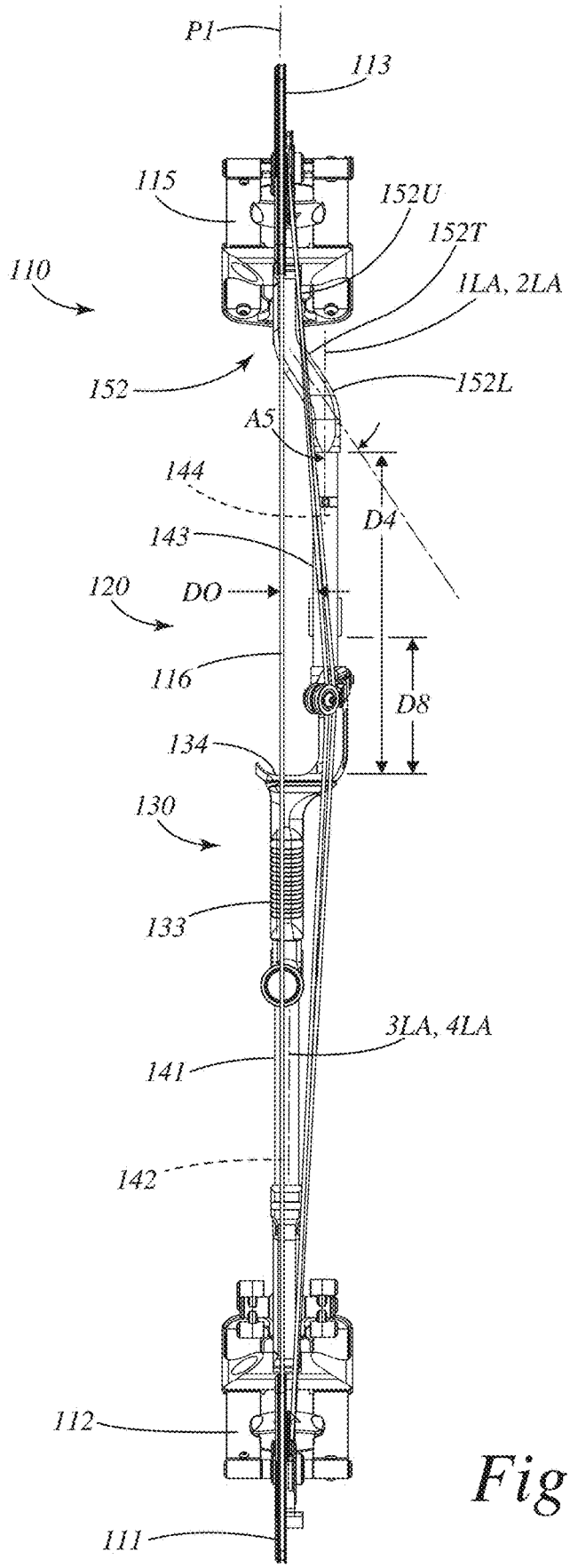
FIG. 8 is a rear view of the archery bow.
Figure 9:
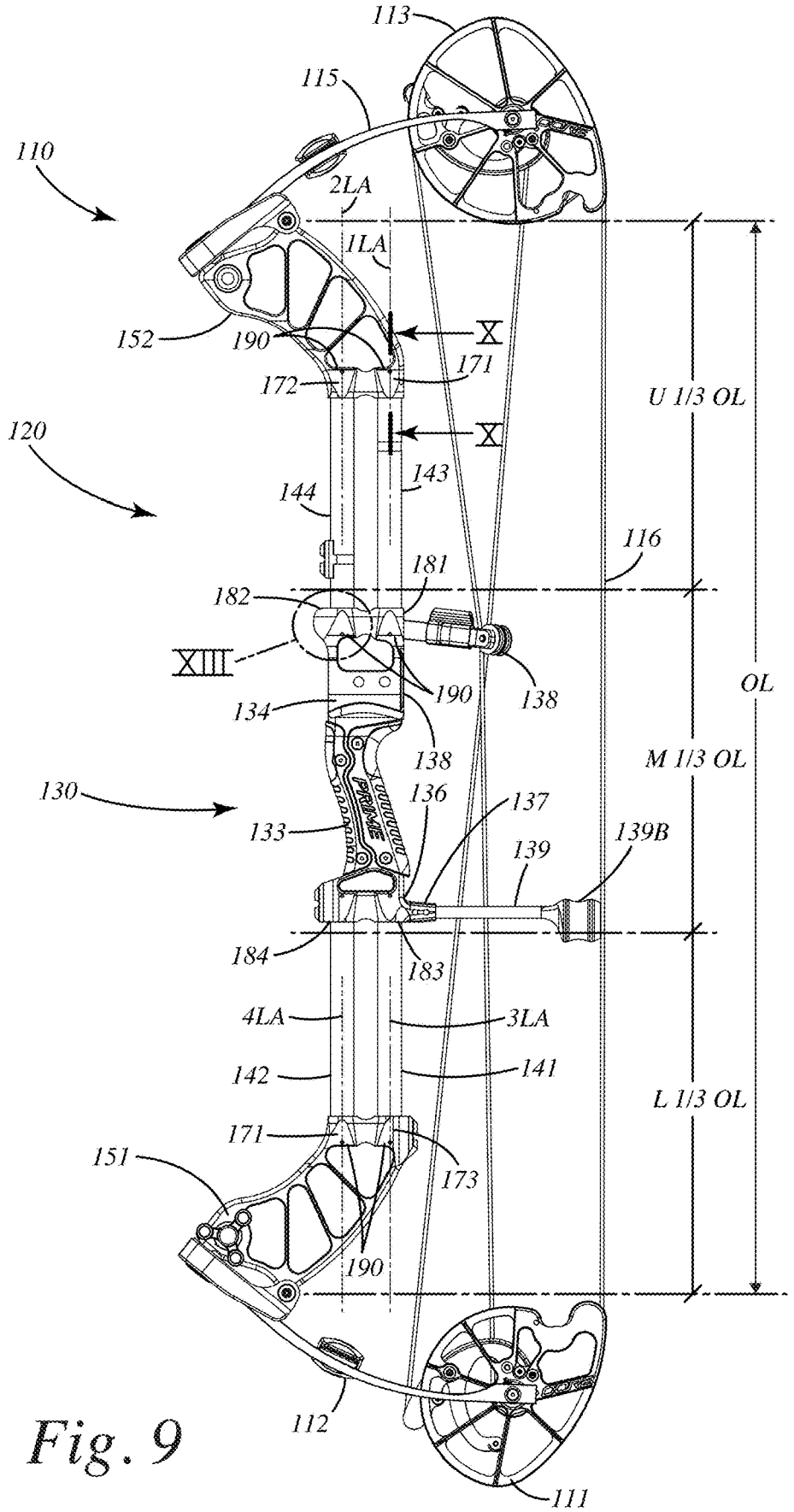
FIG. 9 is a side view of the archery bow.

The primary riser tubes 141, 142, 143, 144 can be tubular and hollow from one end to another. Each tube can be bounded by a tube wall as described in connection with the embodiment above, which can circumferentiate a linear axis of the respective tube. For example, as shown in FIGS. 8-9, the first upper primary riser tube 143 and second upper primary riser tube 144 are shown with a respective first linear axis 1LA and second linear axis 2LA. The first lower primary riser tube 141 and second lower primary riser tube 142 are shown with a respective third linear axis 3LA and fourth linear axis 4LA. These linear axes can correspond to the centers of the tubes, generally forming longitudinal axes of the respective tubes, optionally with the wall or walls being disposed at a constant radius from the centers of the tubes and the associated linear axis. As mentioned above, the linear axes can be substantially straight as shown, however, where the respective tubes have any curve or contour to them, these axes can be nonlinear and/or curved.

As described above, and shown in FIG. 9, the upper and lower primary riser tubes can be of equal or different lengths. Further, the upper and lower primary riser tubes optionally can come in respective upper and lower pairs. For example, lower primary riser tubes 141 and 142 can be disposed below the riser handle 130, while upper 143 and 144 primary riser tubes can be disposed above the riser handle 130.

With the reference to FIG. 9, the upper 141 and 142 primary riser tubes can be disposed in an upper portion of the overall length OL of the riser 120. For example, the first and second upper primary riser tubes 143 and 144 can be disposed in the upper U1/3OL length of the overall length OL. In different applications, these tubes can be disposed in the upper ⅛, ¼, or ½ of the overall length OL. The upper primary riser tubes 143, 144 originate at the upper strut 152 and extend downward from there to the riser handle 130 and associated riser ports as described below. The grip 133 can be disposed below a shelf 134 of the riser handle 130. The upper primary riser tubes 143 and 144 can terminate at the riser handle without extending below the grip 133 and/or the shelf 134. In this case, the first and second upper primary riser tubes 143, 144 are isolated to the portion of the riser 120 above the riser handle 130 and below the grip 133 of the handle. Optionally, nothing but the grip 133 and/or the riser handle 130 connects the first and second upper primary riser tubes 143, 144 to the first and second lower primary riser tubes 141, 142 extending below the shelf 134 of the riser handle 130 and its grip 133.

Further optionally, as shown in FIG. 9, none of the lower primary riser tubes 141, 142 extend upward beyond the middle M of the riser 120 or generally of the overall length OL. Likewise, none of the upper primary riser tubes 143, 144 extend downward beyond the middle M of the overall length OL. Further, none of the primary riser tubes extend continuously or completely from the first limb to the second limb. Further as shown, the riser handle 130 optionally can be the only structure connecting the lower primary riser tubes 141 and 142 and the upper primary riser tubes 143 and 144. As described, that riser handle can be a separately constructed part from the tubes, and constructed from a different material such as a metal, for example, aluminum, titanium, steel or some other metal or plastic. The upper and lower tubes can be discontinuous and unconnected except for this riser handle, and themselves can be constructed from another material, such as the carbon composite or a different type of metal from the tubes. The tubes, riser handle and any struts also can be separate and independent parts and pieces, that are assembled to one another to form the riser 120. This can be different from a monolithic, one piece riser constructed from carbon, which typically is more complex to mold, form and test for consistency in structure and function, and sometimes harder to tune when included in an archery bow.

Optionally, one or more of the upper and lower primary riser tubes can be substituted or replaced with solid rods, bars or other elongated elements. As used herein, an elongated element can be any of those items, that is, a tube, rod or bar. Such elongated elements can have circular, elliptical, polygonal and/or round cross sections, and further optionally can be obtained, cut or formed from stock bars, rods and/or tubes.

Yet further optionally, although not shown, the primary riser tubes herein can be filled with a variety of materials. For example, the interior of any one or more tubes can be fully or partially filled with foam, plastic, rubber, silicone and/or a variety of polymers. In another example, the interior of any one or more tubes can be fully or partially filled with composite materials, fibers, chips, beads, fragments and/or uniquely dimensioned and shaped elements. As a further example, the interior of any one or more of the tubes can be fully or partially filled with wood, wood chips, wood shavings, wood plugs, metal, metal shavings, metal fibers, metal wire, metal beads, and/or any combination of any of the foregoing materials and items above. Further, and any of the above materials can be in solid, liquid and/or gel form when inside the tubes.

As shown in FIG. 8, the upper primary riser tubes 143, 144 and lower primary riser tubes 141, 142 can be oriented in a particular configuration relative to the bowstring plane P1 of the bowstring 116. For example, as shown, the bowstring plane P1 can intersect the respective lower primary riser tubes 141 and 142. The bowstring plane P1 can commonly intersect the riser handle 130 as well as the shelf 134 of the riser handle. The upper primary riser tubes 143 and 144 however can be offset a distance DO laterally from the bowstring plane P1. This distance DO can be optionally about 1 inch, about two inches, about 3 inches, between 1 inch and 4 inches, inclusive, between 1 inch and 3 inches inclusive, between 1 inch and 2 inches inclusive or other distances depending on the application and the configuration of the riser. The linear axes 1LA and 2LA of the respective upper riser tubes 143 and 144, which can be the linear longitudinal axes thereof, likewise can be offset this distance DO or slightly more from the bowstring plane P1. These linear axes can be further parallel to the bowstring plane P1.

Optionally, the linear axes 1LA and 2LA can be laterally offset and parallel to the bowstring plane P1 for a distance D4 that can be optionally at least 1 inch, at least 2 inches, at least 3 inches, at least 3 inches, at least 6 inches, at least 10 inches, at least 12 inches, between 4 inches and 12 inches, inclusive, between 6 inches and 12 inches above the riser handle 130 and/or the shelf 134 associated with the riser handle.

Further optionally, in some applications, the linear axes 1LA and 2LA can be offset at some angle relative to the bowstring plane, for example, 1 degree to 15 degrees, inclusive, 1 degree to 10 degrees, inclusive, 1 degree to 5 degrees, inclusive, or other angles depending on the application. As shown, however, these axes can be parallel to the bowstring plane.

As further shown in FIG. 9, the third linear axis 3LA and fourth linear axis 4LA can be parallel to the bowstring plane P1, and further parallel to the first linear axis 1LA and second linear axis 2LA of the upper riser tubes. The third and fourth linear axes can be parallel to but offset relative to the first and second linear axes. In some cases, the bowstring plane could be defined such that the third linear axis 3LA and fourth linear axis 4LA of the respective lower primary riser tubes are disposed in the bowstring plane P1. In other applications, these third and fourth linear axes also can be offset at some angle, relative to plane P1, with that angle being the same as that described above in connection with the first and second linear axes. In yet other applications, the lower primary riser tubes can be offset from the bowstring plane the same distance DO as described below and in the same direction as the upper primary riser tubes.

Where the upper primary riser tubes 143 and 144 are offset the distance DO from the bowstring plane P1, the upper strut 152 can be configured such that the riser 120 transitions back toward the bowstring plane whereby the limb 115 and cam 113 can be centered on that plane P1. For example, the upper riser strut 152, which can be constructed from metal or some different material than the riser tubes, can include a lower portion 152L, a transition portion 152T and an upper portion 152U. The lower portion 152L can define one or more riser ports as described below. The lower portion can be somewhat parallel to the riser tubes 143 and 144. The transition portion 152T, however, can be angled or curved relative to the lower portion 152L. For example, the transition portion 152T can angle at some angle A5 from the lower portion to the upper portion. This angle A5 optionally can be about 1 degree to about 30 degrees, inclusive, about 1 degrees to about 30 degrees, inclusive, about 5 degrees to about 30 degrees, inclusive, about 20 degrees to about 30 degrees, inclusive, or other angles depending on the distance from the bowstring plane P1. The transition portion 152T can extend and connect to the upper portion 152U. The upper portion 152U can overlap the bowstring plane P1. Optionally, the bowstring plane P1 can intersect the upper portion 152U, and in some cases part of the transition portion 152T. However, the lower portion 152L of the strut 152 can be displaced laterally from that bowstring plane P1, in some cases by the distance DO.

Optionally, the upper riser handle ports and the lower riser handle ports can be separate and independent of one another, with a handle between the upper and lower riser handle ports such that those ports are not connected to or an extension of one another. The ports optionally might not pass through the riser handle or components thereof. The ports can separately and independently accommodate and receive the respective plugged in upper and lower riser tubes. Each port can include a bottom past which a tube does not extend. Further optionally, as shown, the upper primary riser tubes and lower primary riser tubes, or other elongated elements as described herein, can be separate, discontinuous and/or independent from one another, not connected to one another, not joined with one another, and/or not forming continuous components from the first limb to the second limb past the riser handle. Yet further optionally, with the upper and lower tubes being separate, vibration from the upper limb to the lower limb is not transferred as efficiently or in such magnitude as would be the case if the upper and lower tubes were continuous or joined with one another.

As mentioned above, the riser handle 130 and the respective struts 151 and 152 can include one or more ports that can be configured to attach respective primary riser tubes to those respective components. The ports can be similar or identical to the ports described above in connection with the current embodiment of the riser 20. The ports can further include all of the interlocking features as well as interior posts and other structures that can center, stabilize and reinforce their respective tubes and or attach those tubes to the ports of the different components.

For example, the riser handle 130 as shown in FIGS. 7 and 9 can include first and second upper handle ports 81 and 82 that extend upward, away from the shelf 134. The riser handle 130 further can include opposing first and second lower handle ports 183 and 184 disposed below the grip or grasping portion 133 of the riser handle 130. The first and second upper handle ports 181 and 182 can generally extend upward, toward the upper limb 115, while the lower handle ports 183 and 184 can generally extend downward from the riser handle 130, toward the lower limb 112. The upper primary riser tubes 143 and 144 can be plugged into the respective first and second upper handle ports 181 and 182. The lower primary riser tubes 141 and 142 can be plugged into the respective first and second lower handle ports 183 and 184.

Optionally, the riser handle 130 can include additional features and components, which can be integral with, fastened to or otherwise secured to the riser handle. For example, as shown in FIGS. 7 and 9, the riser handle 130 can include an upward plate 135 that extends upward above the shelf 134 and connects to the respective ports 181 and 182 for the tubes. The plate can be offset from the bowstring plane P1 and can be solid and rigid with the shelf and the grip 133. The plate and/or the ports can include one or more threaded holes to received fasteners to secure ta cable guard 138 to the riser handle. The cable guard 138 can extend rearward from the riser handle and/or the plate, to cable of the bow 110 to secure them in an orientation and location relative to the riser as shown. The cable guard 138 as shown is secured to the riser handle only, and not to any of the primary riser tubes, from which it is distally disposed and not in contact. Where the riser handle is constructed from metal, this can provide a rigid connection to the riser for the cable guard. Further, attachment of the cable guard to the riser handle can avoid the formation of holes or gaps in the carbon tube. Of course, in alternative embodiments, the tubes can include the connector lugs described below, which can be used to secure the cable guard to those tubes directly.

Further optionally, the riser handle 130 can include and bowstring stop mount 137 to which a bowstring stop 139 is mounted. The mount 137 can be integrally formed or secured to the lower portion 136 of the riser handle 130, which can be disposed below the grip 133 thereof. The mount 137 can define a hole or aperture therein. A rod or bar of the string stop can project into that bar and can be transverse to the linear axes of the lower primary tubes 141 and 142. In some cases, the bar can include a longitudinal axis that can be perpendicular to and can intersect the respective linear axes of the lower primary tubes. The bar 139 can extend rearwardly away from the riser handle and can terminate or include a string bumper 139B which is configured to allow the string 116 to engage that element and reduce vibration or otherwise stop movement of the string 116 when the bow is shot. As shown, the string stop mount 137 can extend reward from the lower port 183 and can be secured thereto. In other applications, the string stop mount 137 can be located in different locations along the riser handle. The string stop mount 137 and the string stop 139 can be distal from and not connected to or joined with either of the lower tubes 141, 142, nor the upper tubes for that matter. Thus, the string stop can be rigidly attached to the riser handle 130, which again can be constructed from a solid metal material. The riser handle 130 can include and/or can be joined with both the cable guard 138 as well as the string stop 139, in which case one or both of these components are not joined with or are distal from the respective upper primary riser tubes and lower primary riser tubes.

As further illustrated in FIGS. 7-10, optionally, the upper strut 152 can include upper strut ports 171 and 172 that receive the upper ends of the respective upper primary riser tubes 143 and 144. These upper ports can be disposed in the lower portion 152L of that upper strut 152 generally disposed below the upper limb 115 and upper cam 113. Likewise, the lower strut 151 can include lower strut ports 173 and 174 that receive the lower ends of the respective lower primary riser tubes 141 and 144. Those lower ports can be disposed above the lower limb 112 and lower cam 111. Each of the respective sets of ports, for example upper riser handle ports 181, 182 can be aligned with the upper strut ports 171, 172. Similarly, the lower handle ports 183 and 184 can be aligned with the lower strut ports 173 and 174.

Generally, the respective ports of the various components, for example, the handle and the struts, can be similar or identical to one another, so only one port will be described in detail here, with the understanding that the other ports of this embodiment can be similar or identical thereto, but reversed or altered in spatial orientation. It also will be appreciated that any of the ports in this embodiment can be mixed and matched with the other ports and features of such ports of the current embodiment described above, and vice versa.

Figure 21:
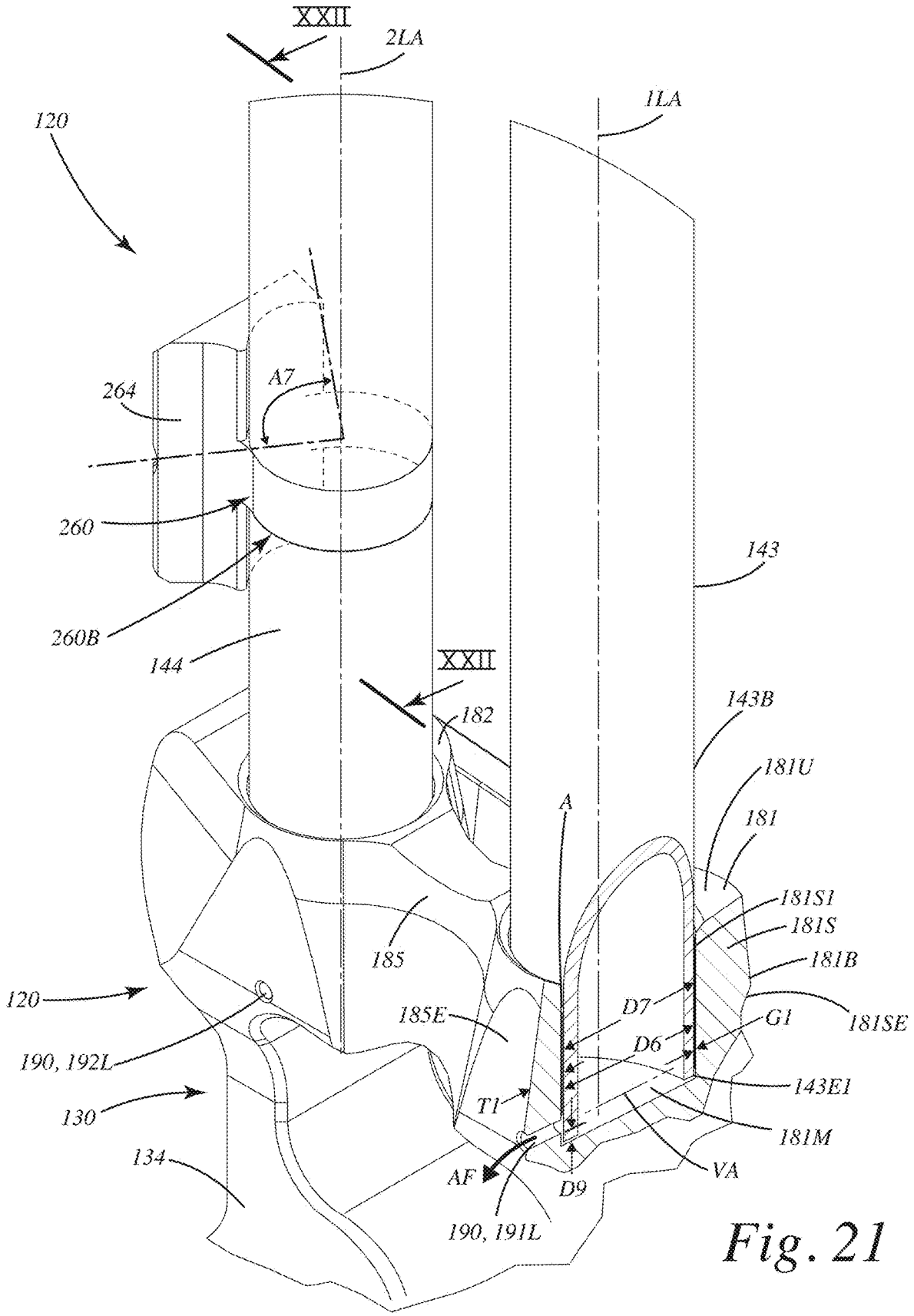
FIG. 21 is a close-up view of another connector lug with an external mount of the first alternative embodiment along a primary tube of the riser.

With reference to FIG. 21, a first upper handle port 181 and a second upper handle port 182 will described in more detail, with the understanding that any of the other handle or strut ports herein can be similar in structure, features, function and operation. The first upper handle port 181 can extend upward, come up generally away from the grasping portion 133 and/or the shelf 134 of the riser handle 130, toward the upper limb 115. The second upper handle port 182 likewise can extend in a similar direction. The ports can be connected or joined with one another via a bridge 185, which can offer structural rigidity to those ports and the handle, as well as fix the spatial orientation of the upper riser tubes 143 and 144 relative to one another. The first riser port 181 can define a first cylindrical bore 181B which can be surrounded by a first port side wall 181S of the riser handle 130. The first port sidewall can include an interior surface 1811 and an exterior surface 181E. The bore 181B again is shown as being of a cylindrical or circular cross section, however where the tubes 143 and 144 are of different cross sections, for example, other rounded, elliptical or polygonal cross sections, that bore 181B can match generally the cross sections of the tubes. The bore 181B can extend downward from an upper portion 181U of the port side wall 181S. This sidewall 181S can extend to a bottom 181M of the bore which bottom as shown can be flat and or planar. This construction can mimic or be similar to the respective cups formed in the ports described in the embodiment above. The sidewall 181S also can include thickness T1 extending from the interior surface 181 of the sidewall 181S to the exterior surface 181SE of the port sidewall 181S. This thickness can be optionally 0.050 inches to 0.750 inches, inclusive, 0.050 inches to 0.500 inches, inclusive, 0.100 inches to 0.500 inches, inclusive, 0.100 inches to 0.250 inches, inclusive, or other thicknesses depending on the material from which the sidewall and riser are constructed, and/or the forces generated by the tubes on the riser.

As further shown in FIG. 21, the first upper primary riser tube 143 can include a first outer diameter D6. This outer diameter D6 can be less than the inner diameter D7 of the bore 181B of the port 181. As a result of this difference, a gap G1 can be formed between the exterior surface of the primary riser tube 143 and the interior surface 1811 of the side wall 181 in the bore 181B. This gap can be an area, region and/or volume where an adhesive can be placed to secure the tube in the port in which it is plugged into when the adhesive cures. This gap G1 can be optionally 0.001 inches to 0.100 inches, inclusive, 0.001 inches to 0.010 inches, inclusive, 0.050 inches to 0.010 inches, inclusive, 0.050 inches to 0.090 inches, inclusive, or other distances, depending on the application and adhesive used. Generally, this gap can be sized so that an adhesive disposed between the tube and the interior surface of the sidewall 181S extends throughout and around the entire tube exterior surface, interfacing between that tube exterior surface and the interior surface 181SI of the side wall to bond those components together, that is the tube to the side wall of the port, when the tube is plugged into the port. Optionally, the gap can be sized so that the tube can be friction fit into the port and can stay generally secured in that port via that friction fit. Given some extreme forces and moments generated through the riser, in many cases, an adhesive, as mentioned above, is applied in the gap to secure the tubes to the riser handle and/or the struts.

As further shown in FIG. 21, the first upper primary riser tube 143 can be plugged into the port 181 such that the proximal edge 143E1 at the lower end of the tube 143 can engage the bottom 181M of the port 181. Both the bottom 181M and the edge 143E1 can be oriented orthogonal to the linear axis 1LA as shown. In other applications, where the tubes 143, 144 are at some offset angle relative to the bowstring plane P1, the edge and bottom can be angled at a corresponding predetermined angle to set the tube at that offset angle.

Optionally, as shown in FIGS. 9 and 21, the first upper handle port 181 and second upper handle port 182 are located above the shelf 134 and the grasping portion 133 of the riser handle 130. The bottoms of those ports also are disposed above these features. Accordingly, the lowermost ends or edges of the respective upper primary riser tubes 143 and 144 are likewise disposed above the shelf 134 and the grip 133, without extending below those features.

Further optionally, the grip 133 can be integral with the riser handle 130 and formed of the same material as the other components thereof. The grip material also can be a different material from the primary riser tubes, and non-integral and not forming a single or unitary piece with those primary riser tubes. The grip 133 can extend between the lower ports 183, 184 and the riser shelf 134, below the upper ports 181, 182 and plate 135 described herein. The grip also can be disposed between the upper and lower riser tubes.

As mentioned above, the primary riser tubes can be joined with the respective riser handle and/or the struts by plugging those primary riser tubes into ports defined by those components. As further mentioned above, one way to secure the tubes in the ports is by using glue, adhesive, cement or some other type of bonding agent, with or without glass beads, collectively referred to herein as adhesive, to chemically and/or physically bond the tubes to and/or within the respective ports. The adhesive generally can be disposed within the gap G1 between the exterior surface of a respective tube and the port, for example, the bore and/or the sidewall 181S facing inward toward the tube as shown in FIG. 21. It has been discovered, however, that sometimes air entrained in the adhesive can cause the adhesive to flow out from the gap G1. As a result, less adhesive remains in the gap, which can thereby lead to poor bonding and/or adhesion of the tube to the port and more particularly of the tube exterior to the interior of the side wall of the bore defined by the port. Further, in some cases, a particular riser tube might be sealed at one end and installed or plugged into a port. As a result, the air trapped inside that tube can become slightly pressurized, and that pressure can push the adhesive out from the gap, again resulting in a poor bond and/or adhesion between the tube in the port with the adhesive. This can make the joint between the tubes and handle or struts inconsistent or weak in some cases. Accordingly, to address this issue concerning the evacuation or seeping of the adhesive from the ports, due to entrained air or pressurized air, the ports of the riser 120 can include one or more vents 190.

One example of a vent 190 is shown in FIG. 21 in connection with the first upper handle port 181 and first upper primary riser tube 143. This particular vent 191L can be similar in structure, function, features placement and operation to various other vents, such as the vent 192L in the second upper handle port 182, as well as the vents in the first and second lower handle ports 183, 184, as well as the various ports in the upper 152 and lower 151 struts. Accordingly, the description of those other vents will not be described in substantial detail, and can be understood with reference to the current description of the vent 191L.

In particular, vent 191L can be configured as a through hole, aperture, slot or other opening extending through the thickness T1 of the first port side wall 181S. The vent can extend from the interior surface 181SI to the exterior surface 181SE of the sidewall 181S. The vent can have a length that is equal to the thickness T1 of the sidewall 181S. The vent 191L can be of a cylindrical configuration as shown, or the vent 191L can be of other configurations and/or cross sections. For example, the vent can be an elliptical hole, a polygonal hole, a rectangular slot, a series of pinholes or small rounded apertures, or a variety of other constructions. Generally, the vent can provide fluid communication between the bore 181B to the environment exterior to the first port sidewall 181S. As an example, the vent can provide fluid communication between the first cylindrical bore 181B to the first exterior surface 181SE and out into the environment. As a result, any air entrained in the adhesive A, or any air that becomes pressurized in the interior of the tube and flows into the gap G1 can flow in direction AF out the vent 191L. In some cases, adhesive A can flow slightly out the vent as well when too much adhesive is applied. This excess adhesive can be wiped or cleaned from the riser handle from around the vent 191L.

As shown, a single vent 191L can provide fluid communication between the bore 181B of the port 181 and the environment, however, additional events can be included to extend through the thickness T1 of the side wall 181S or some other part of the port, depending on the application. These vents can be disposed above, below, around and/or near the vent 191L. In other applications, the vent can be disposed on an opposite side of the port 181.

The vent 191L optionally can be disposed a distance D9 from the bottom 181M of the port 181. This distance D9 can be optionally 0.100 inches to 0.750 inches, inclusive, 0.125 inches to 0.500 inches, inclusive, 0.100 inches to 0.250 inches, inclusive, or other distances. With the vent placed near the bottom, fluid can exit the bore through that vent in some applications.

Further optionally, the vent 191L can include vent axis VA that can be transverse, for example, perpendicular, to the linear axis 1LA of the tube 143. In some cases, the vent axis VA can intersect the first linear axis 1LA or other linear axis of the tube. The vent axis VA can be parallel to the bottom 181M of the port as shown, however in other applications, the vent axis VA might be transverse and/or angled at some angle relative to that bottom. In yet other applications, a vent may extend through the bottom of the port itself.

Figure 10:
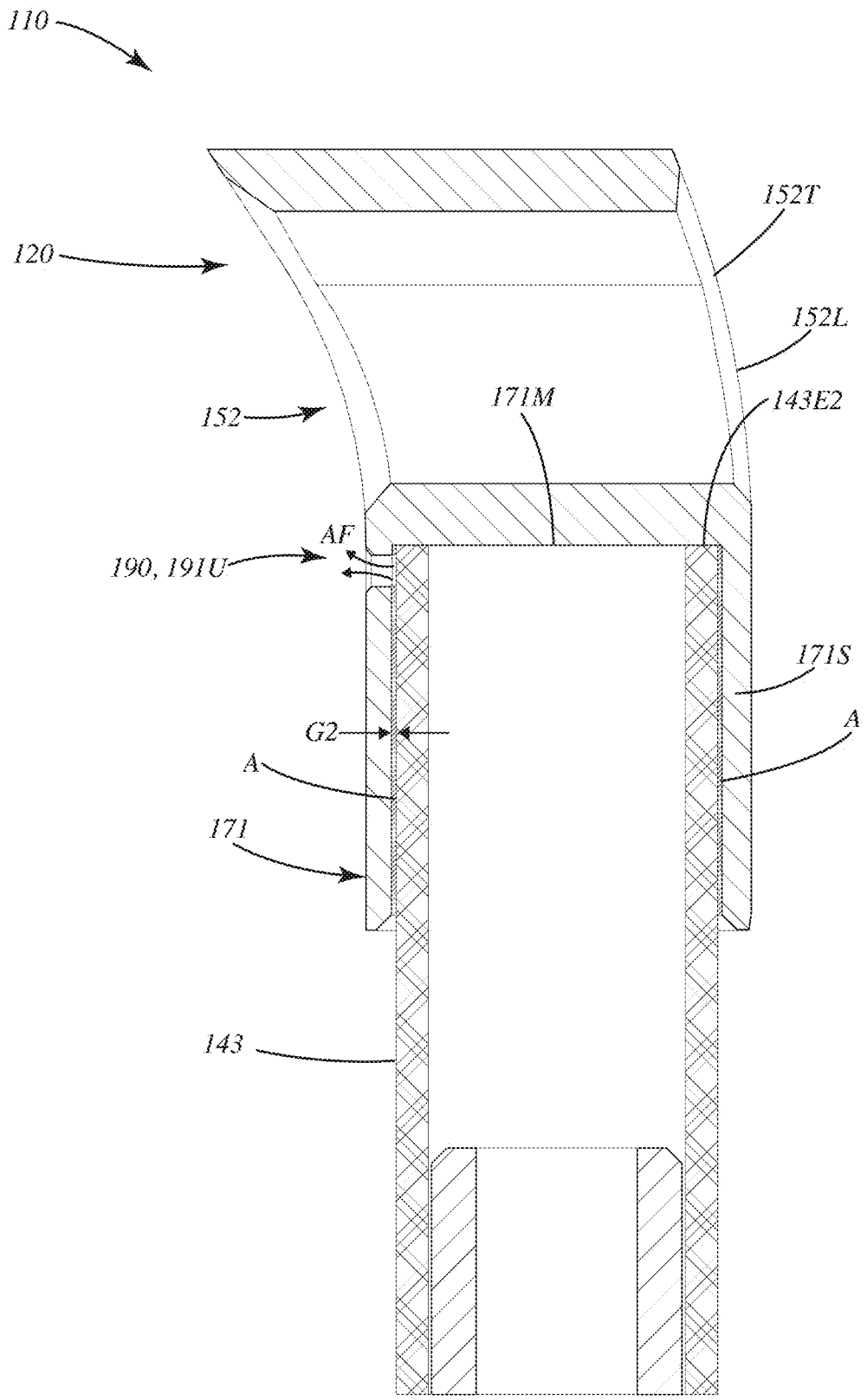
FIG. 10 is a section view taken along lines X-X of FIG. 9 showing a vent of the first alternative embodiment in fluid communication with a port of the riser.

A variety of different vents 190 are contemplated for use with the ports of the handle riser and struts described herein. The vent 191L described above is used in connection with the first upper riser handle port 181 into which the first upper primary riser to 143 is inserted. That same primary riser tube 143 can also be inserted into another riser port 171 of the upper strut 152. As shown in FIG. 10, the upper opposite end of the first upper primary riser tube 143 can be plugged into the first port 171 of the strut 152. Like the first upper handle port 181 described above, the upper edge 143E2 of that tube can be bottomed out against the bottom 171M of the port 171. An adhesive A can be disposed between the port sidewall 171S and the exterior surface of the tube 143, within the gap G2 between those elements. This port 171 also can include a vent 190, 191U, similar to the vent 191L described above. Via this vent, air entrained in the adhesive and/or disposed in the gap G2 can escape and flow in direction of the arrows AF out the vent such that the adhesive can bond consistently and well to the side wall 171S and the tube 143, similar to that described above in connection with the first upper handle port 181. It will be appreciated that each of the various primary riser tubes can be disposed adjacent respective vent holes at the respective ends of each of those tubes such that air can escape the ports and allow the adhesive to bond constantly and well between the tubes and ports.

Figure 12:
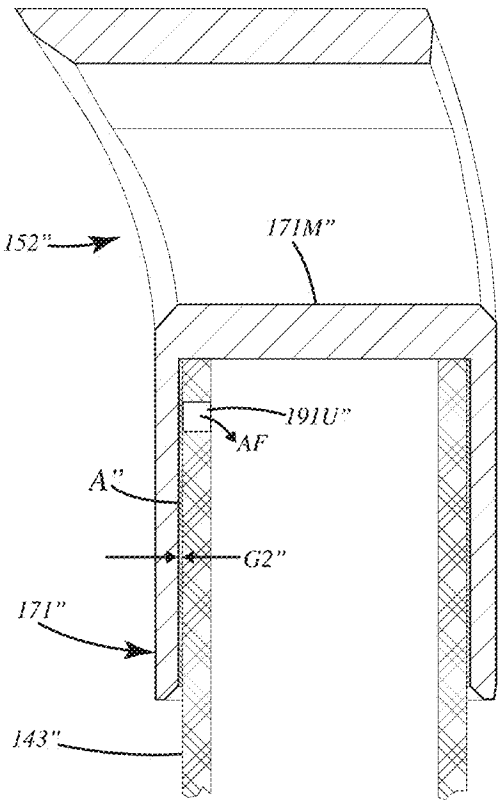
FIG. 12 is a section view taken along lines X-X of FIG. 9 showing a vent of a third alternative embodiment in fluid communication with a port of the riser.
Figure 11:
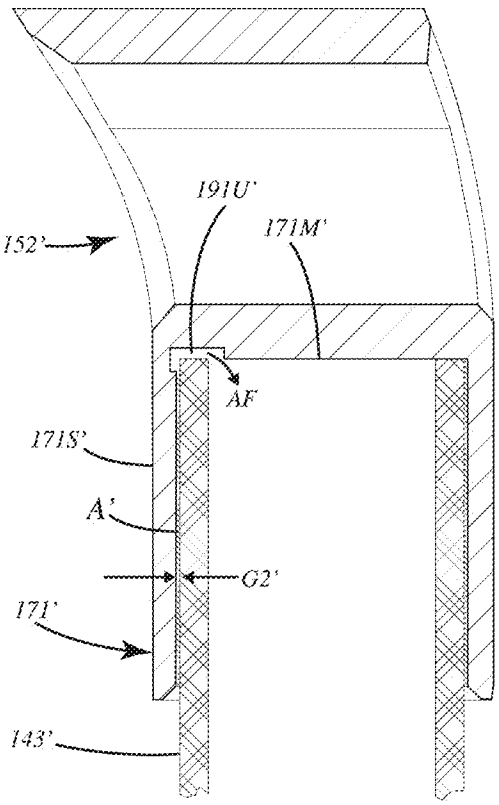
FIG. 11 is a section view taken along lines X-X of FIG. 9 showing a vent of a second alternative embodiment in fluid communication with a port of the riser.

Further alternative vents for use with the risers herein are shown in FIGS. 11 and 12. In FIG. 11, a port 171' can be defined in an upper strut 152'. A primary riser tube 143' can be plugged into the port 171'. A vent 191U' can be defined in a portion of the sidewall 171S as well as a portion of the bottom 171M' of the support to provide fluid communication between the gap G2' and the interior of the tube. Thus, air entrained in the adhesive A' or other fluid can flow in direction AF into the interior of the first tube 143', and thus can exit the gap. FIG. 12 shows another construction where the tube 143" is plugged into a port 171" of the upper strut 152". In this configuration however, the tube 143" defines the vent 191U". Thus, air entrained in the adhesive A" can flow in direction AF into the interior of the tube, and thus exit the gap, rather than into the environment or outside the strut. Other alternative vents are contemplated herein to facilitate air or fluids to exit the gap while allowing enough adhesive to remain in the gap.

As described herein, the primary riser tubes 141-144 can be plugged into ports of the riser handle 130 and/or the struts 151, 152. The riser tubes can be chemically and/or physically bonded to the ports, and to the sidewalls of the plugs via an adhesive as described herein. In some cases, the mechanical bond between the riser tube and the port can be enhanced via one or more mechanical interlocking features. One such feature is a mass reducing recess that is defined in at least one of the primary riser tubes and the sidewall of a port into which the tube is plugged. Examples of these mass reducing recesses can include grooves, threading, holes, perforations, knurling, slits, slots and the like defined in one or both primary riser tubes and/or the side walls of the ports into which they are installed.

Figure 14:
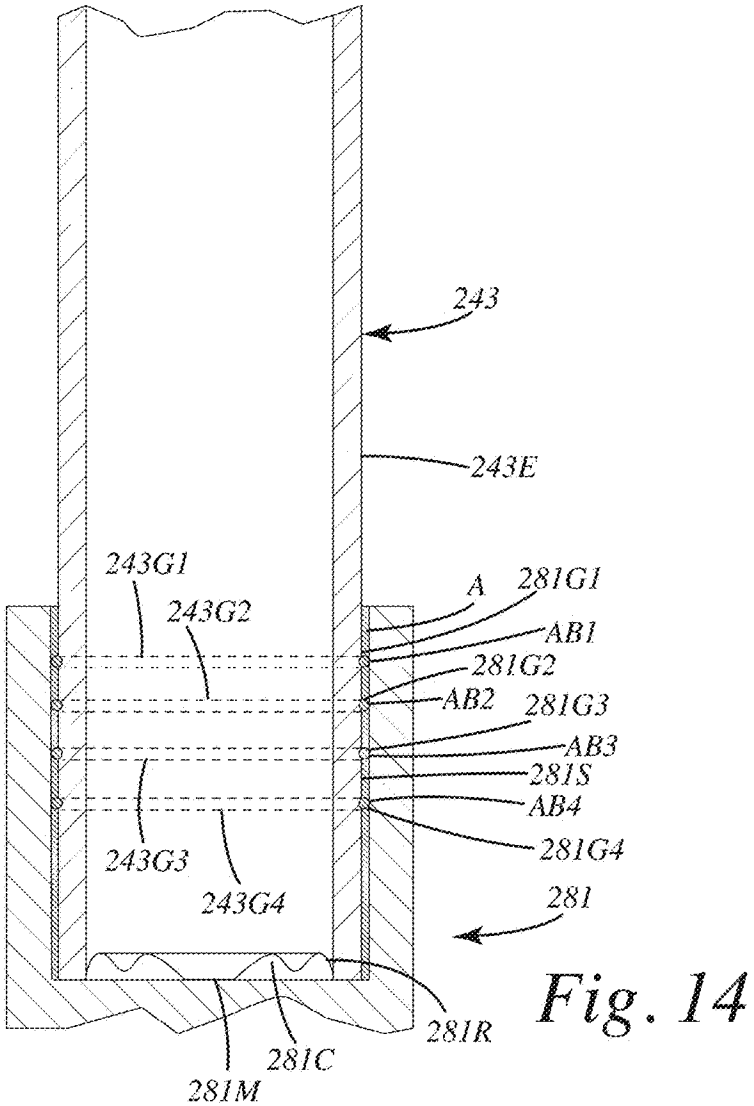
FIG. 14 is a section view taken along lines XIV-XIV of FIG. 13 showing the mechanical interlock of the first alternative embodiment between the tube and a port of the riser.
Figure 13:
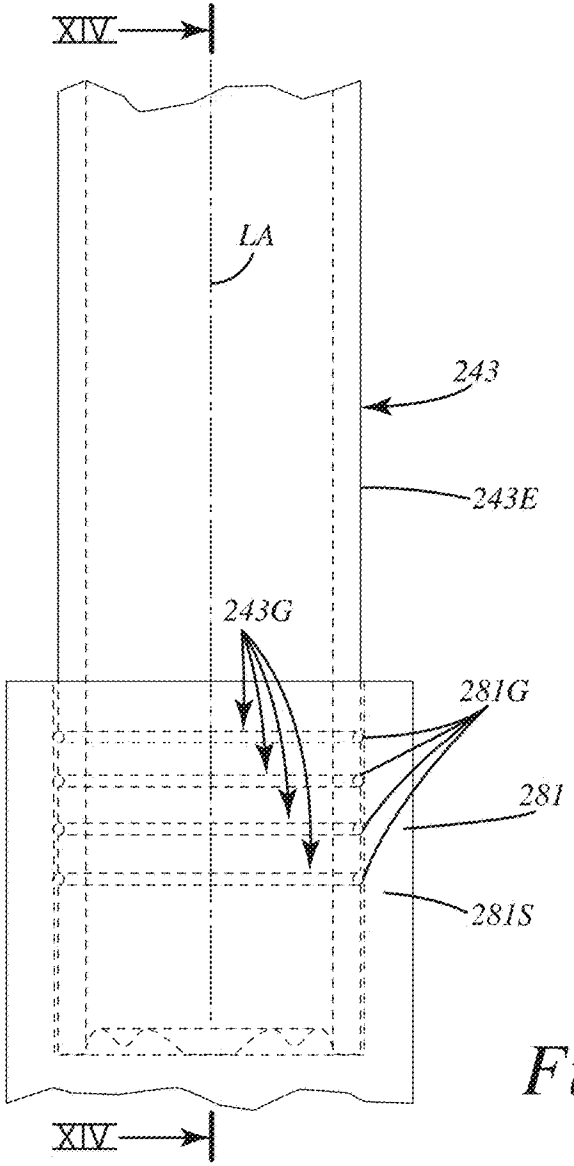
FIG. 13 is a close-up view taken at line XIII of FIG. 9 showing a mechanical interlock of the first alternative embodiment between the tube and a port of the riser.

With reference to FIGS. 13 and 14, one type of mass reducing recess and mechanical bond is illustrated. There, riser tube 243 can be installed in a port 281 including a sidewall 281S. The exterior 243E of the riser tube 243 can define one or more annular grooves 243G that extend around the linear axis LA of the tube 243. The port also can define one or more corresponding grooves 281G in the port sidewall 281S. These mass reducing recesses can be formed by machining, etching, forming, cutting or other techniques. As shown in FIG. 14, when an adhesive A is applied to the end of the tube 243 and the tube is plugged into the plug 281, that adhesive can extend and flow into each of the respective annular grooves 243G1, 243G2, 243G3, 243G4 of the tube 243 defined in the exterior 243E of the tube. The adhesive A also can flow into and fill the respective grooves 281G1, 281G2, 281G3 and 281G4 of the side wall 281S. After the adhesive A cures, it can form interlocking ridges and/or bulges AB1, AB2, AB3, AB4 in the regions where it coextends into the respective grooves defined by the tube exterior and/or the interior surface of the side wall 281. As a result, the adhesive extending into or filling such mass reducing recesses can enhance the mechanical bond between the primary riser tube in the port. Although illustrated with a generic primary riser tube and port in FIGS. 13 and 14, the mass reducing recesses and associated mechanical bonds can be applied to and used with the first upper primary riser tube, the second upper primary riser tube, first lower primary riser tube, the second lower primary riser tube, and their corresponding first upper handle port, second upper handle port, first lower handle port, second lower handle port, upper strut ports and lower strut ports.

Optionally, as shown in FIG. 14, the port 281 can include one or more centering or placement projections 281C, which optionally can be in the form of rings. Of course, they can be posts, bumps, recesses or other features. These projections can be located on the floor 281M of the port 281. The projections can be in the form of annular, concentric rings. The outer ring can include a ramp 281R which can be used to guide the edge or end of the tube downward toward the bottom 281M, so that the end of the tube surrounds the rings. The projections generally can be used to add rigidity and strength to the end of the tube when plugged in the port, or to guide it toward the bottom of the port.

Figure 16:
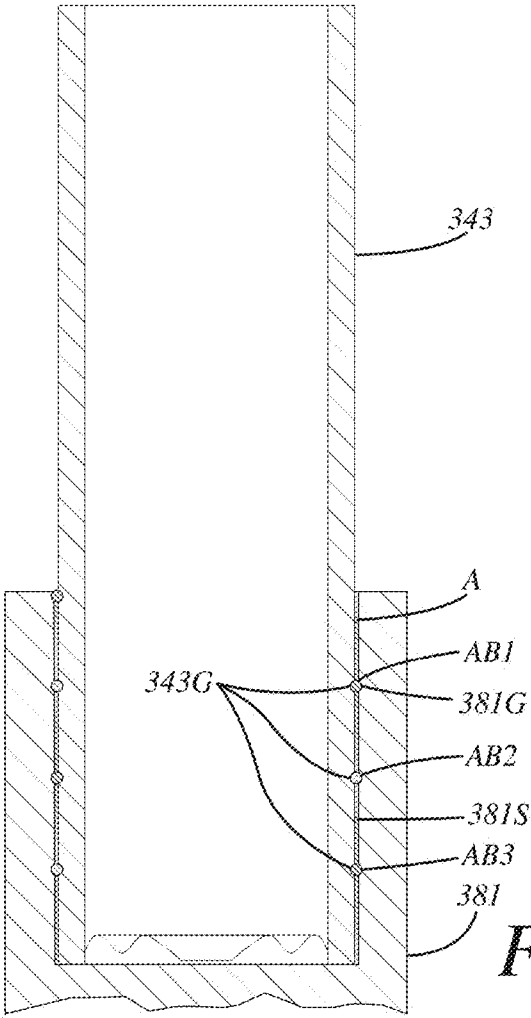
FIG. 16 is a section view taken along lines XVI-XVI of FIG. 15 showing the mechanical interlock of the fourth alternative embodiment between the tube and a port of the riser.
Figure 15:
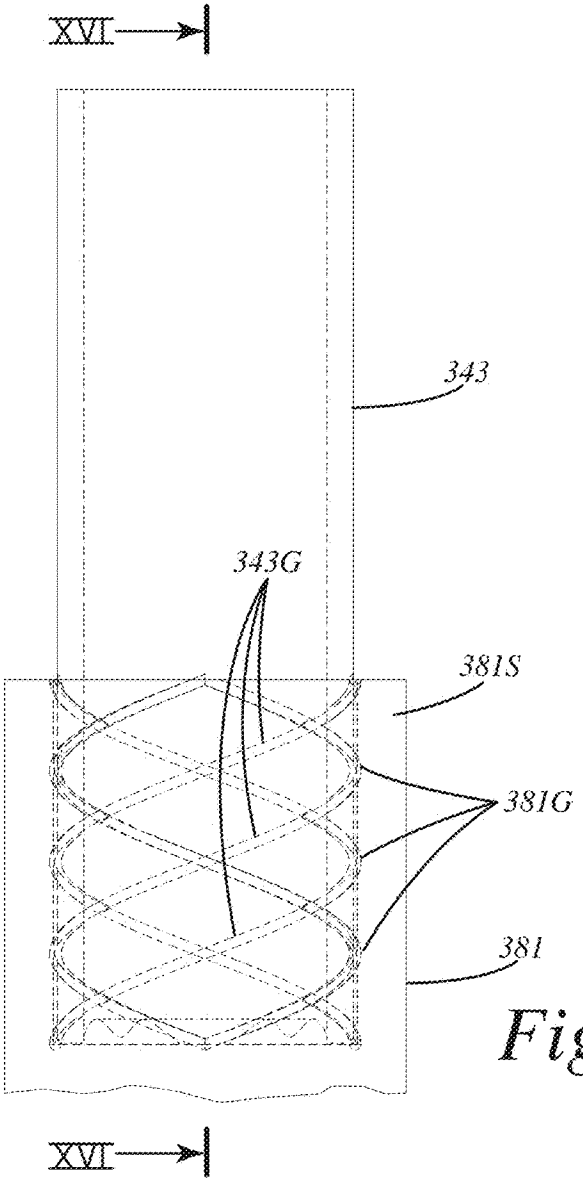
FIG. 15 is a close-up view taken at line XIII of FIG. 9 showing a mechanical interlock of the fourth alternative embodiment between the tube and a port of the riser.

With reference to FIGS. 15 and 16, another type of mass reducing recess and mechanical bond is illustrated. There, the mass reducing recess can be in the form of knurling and/or spiraled grooves 343G defined in the exterior surface of the tube 343. One or more corresponding or additional or different grooves 381G can be formed in the interior surface of the side wall 381S of the port 381. Similar to the embodiment shown in FIGS. 13 and 14, the adhesive A flows into and fills the respective mass reducing recesses 343G and/or 381G of respective tube 343 and/or the sidewall 381S of the port 381. Upon curing of the adhesive A, it can form mechanical ridges or bulges AB1, AB2, AB3 to mechanically lock the tube in the port. Other types of surface treatment are contemplated for enhancing the mechanical bond between the riser tube and a respective port. Similar to the construction above, these types of mass reducing recesses can be applied to any of the primary riser tubes and ports herein.

Figure 17:
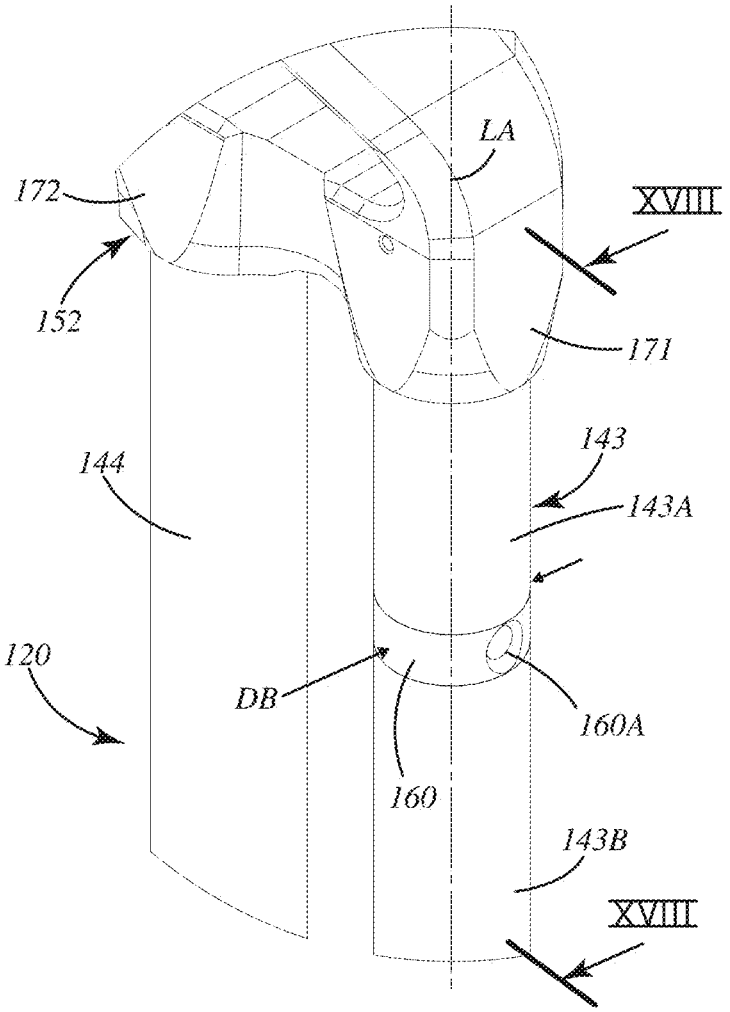
FIG. 17 is a close-up view of a connector lug of the first alternative embodiment along a primary tube of the riser.
Figure 18:
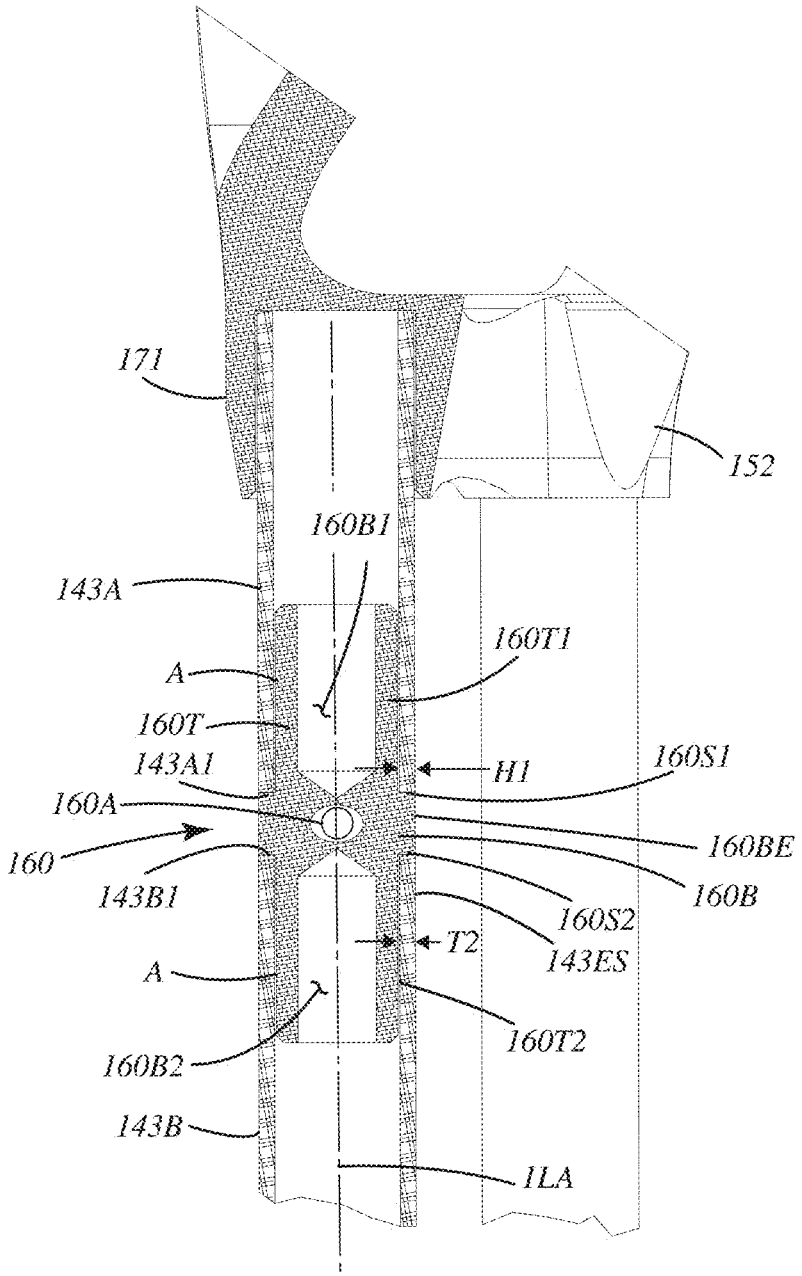
FIG. 18 is a section view taken along lines XVIII-XVIII of FIG. 17 showing the connector lug of the first alternative embodiment.
Figure 19:
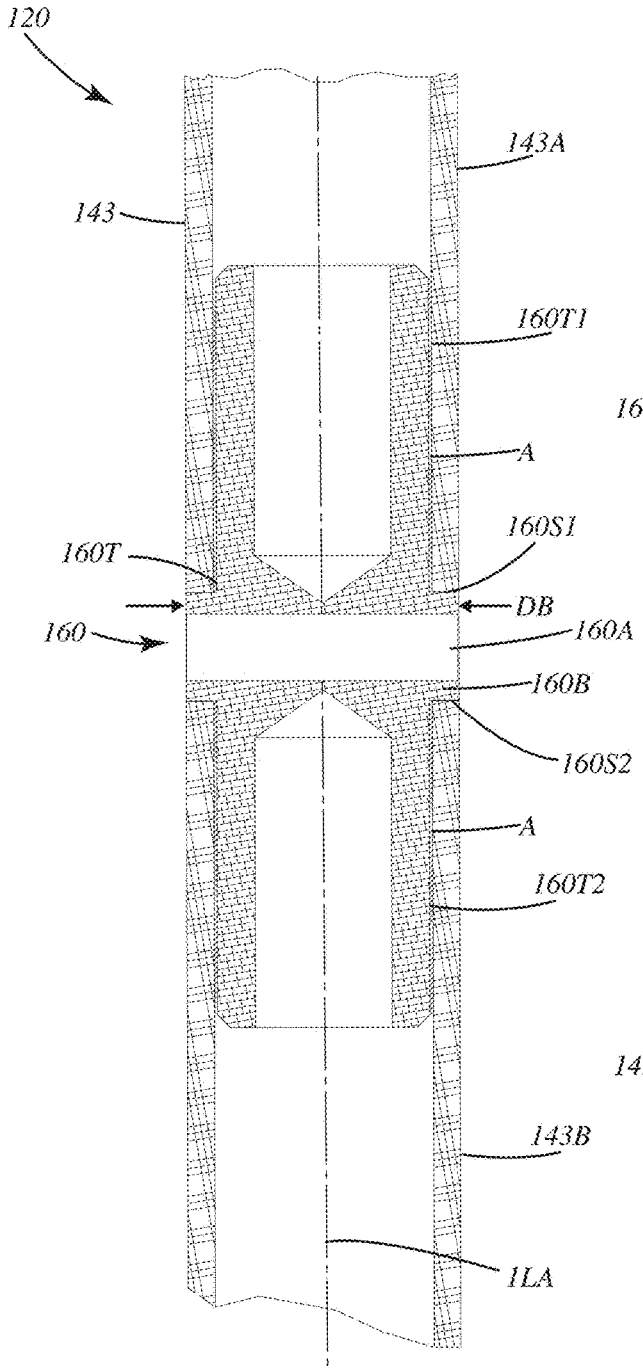
FIG. 19 is a section view taken along lines XVIII-XVIII of FIG. 17 showing a connector lug of the first alternative embodiment.

The embodiments of the archery bow described herein can include one or more connector lugs, which can provide an attachment area and/or element to join an archery accessory to any primary riser tube with which it is associated. The archery accessory can be in the form of a quiver, an arrow rest, a sight, a stabilizer, a cable guard or a variety of other attachments to an archery bow. With reference to FIGS. 17-19, an exemplary connector lug 160 is shown installed relative to first upper primary riser tube 143. This connector lug 160 can be joined with any of the other primary riser tubes described herein, above or below the riser handle 130. This connector lug 160 optionally can be configured to join a quiver to the riser 120 by screwing a threaded fastener, such as a screw, into aperture 160A of the connector lug, which aperture itself may or may not be threaded. Of course other types of mounts or fastening elements as described below can be associated with the connector lug 160 to join an archery accessory to any primary riser tube.

As shown in FIGS. 17 and 18, the connector lug 160 can include an elongated body 160T. This elongated body can include a first male portion 160T1 and a second male portion 160T2 with a band 160B located between these portions. The first male portion 160T1 can extend into and be installed within the first tube portion 143A of the primary riser tube 143, while the second male portion 160T2 can be installed and inserted into a second tube portion 143B below the first tube portion 143A. The respective male portions 160T1 and 160T2 can fit well within the interior diameter of those tube portions 143A and 143B, and within a gap between the tube portions and the male portions. An adhesive A can be applied within the gap to secure the elongated body 160T in place relative to the tube portions 143A and 143B. Optionally, the tube portions and the male portions can include the mass reducing recesses or other features described herein to provide a further mechanical interlock between the tube portions and the body of the connector lug 160. Further optionally, each of the respective male portions 160T1 and 160T2 can define respective bores 160B1 and 160B2 to reduce the weight of the connector lug.

As shown, the elongated body 163 also can include band 160B which can include an exterior surface 160BE. This exterior surface 160BE can be flush with the exterior surface 143E of the tube portions 143A and 143B to provide a clean, finished appearance. The band can be generally cylindrical to match the exterior surface of the tube portions. The band also can extend around the first linear axis 1LA of the first upper primary riser tube 143, or any other tube with which the connector lug is associated. The band can form an exposed lug interface between the first tube portion and the second tube portion. The band can extend a height H1 from the respective male portions. The band also can form the first shoulder 160S1 and a second shoulder 160S2 adjacent the exterior surface 160BE of the band 160B. The height H1 can be greater than the thickness T2 of the side wall of the primary riser tube 143. The band can be of this uniform height H1 from the first shoulder to the second shoulder so the band has a uniform height circumferentiating the linear axis 1LA. These first and second shoulders can be configured to abut and engage the edges 143A1 and 143B1 of the respective tube portions. These edges can be clean cut and can mate against the respective shoulders. These edges can form rounded shapes, and can be circular, elliptical, polygonal with rounded corners, or other rounded shapes. The shapes may or may not correspond to the shape of the bore of the port and/or the bottom of the port in which the tube is plugged, inserted or disposed.

Optionally, although shown as including male portions 160T1 and 160T2, the connector lug 160 alternatively can include female portions (not shown) into which the respective tube portions 143A and 143B interfit. These female portions could be in the form of sleeves, in which the respective tube portions could be inserted and eventually rest adjacent the central band of the elongated body 160T.

As mentioned above, the connector lug 160 can define an aperture 160A. This aperture 160A can be threaded and as shown in FIG. 19, can extend generally through the band. The aperture can include an opening defined on the exterior surface of the band on one side of the linear axis 1LA, and another opening formed on the opposite side of that linear axis. In some cases, the aperture 160A can extend completely through the diameter DB of the body 162, through the band 160B. The aperture can be threaded completely through the body with a plurality of threads to receive a fastener in the aperture. The aperture can be transverse, for example perpendicular to, the longitudinal linear axis 1LA of the tube and body. The axis 1LA also can intersect the aperture. A fastener can be threaded in the aperture and further joined to an archery accessory to secure that archery accessory directly to the connector lug.

Optionally, the threaded aperture 160A can be centered between the respective shoulders 160S1 and 160S2 so as to provide a balanced loading on the respective male portions of the connector lug and the associated tube portions. Although not shown, the aperture 160A might not extend all the way through the diameter DB of the band and/or the connector lug. Further optionally, the aperture 160A might not be threaded and can instead include a latch or other connection to which another element can be secured, depending on the application.

Figure 20:
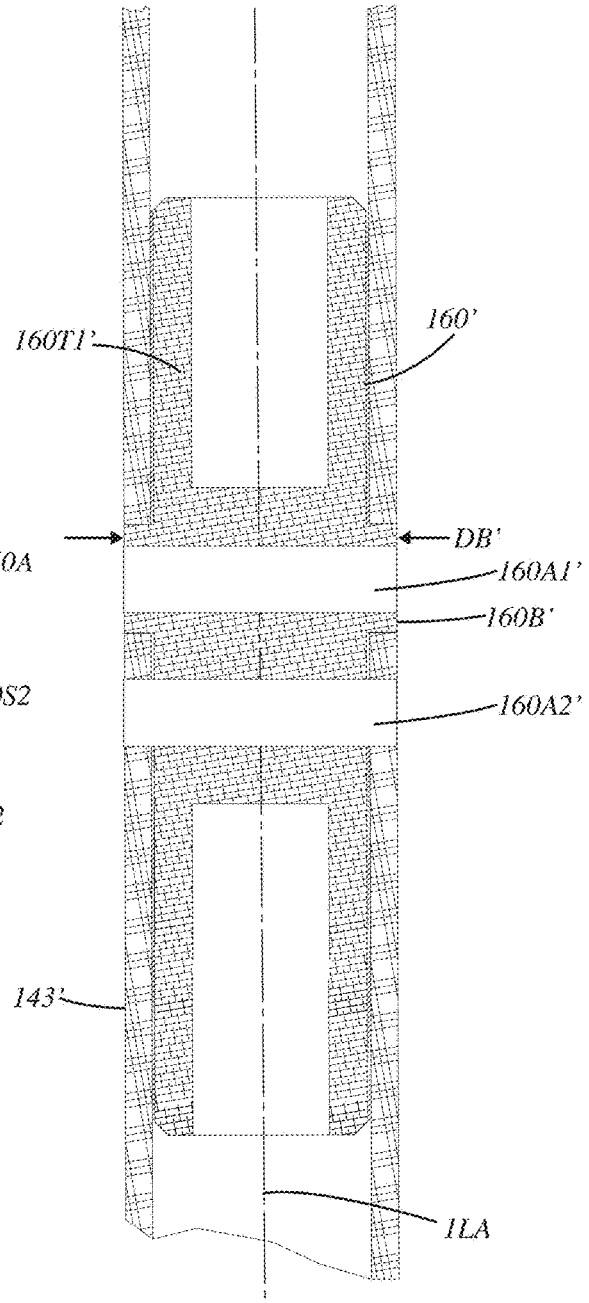
FIG. 20 is a section view taken along lines XVIII-XVIII of FIG. 17 showing a connector lug of a fifth alternative embodiment.

An alternative configuration of the connector is shown in FIG. 20. There, tube 143' and the connector 160' can include the respective male portions that extend into upper and lower corresponding tube portions. In this construction however, the band 160B' can be longer and can define a first aperture 160A1' and a second aperture 160A2' extending through the diameter DB' (or other dimension if not a cylindrical construction, e.g. the band has a polygonal exterior) of the band and the body 160T1'. With the additional aperture 160A2', the connector lug can be used to mount accessories in a particular orientation relative to the riser, such as an archery sight or archery arrow rest. The connector can enable two fasteners to secure the archery accessory to the connector lug, which in turn can prevent or restrain rotation of the archery accessory relative to the primary riser tube 143' with two points of connection. Of course, additional apertures can be defined in the connecter lug 160' to connect various types of archery accessories.

Figure 22:
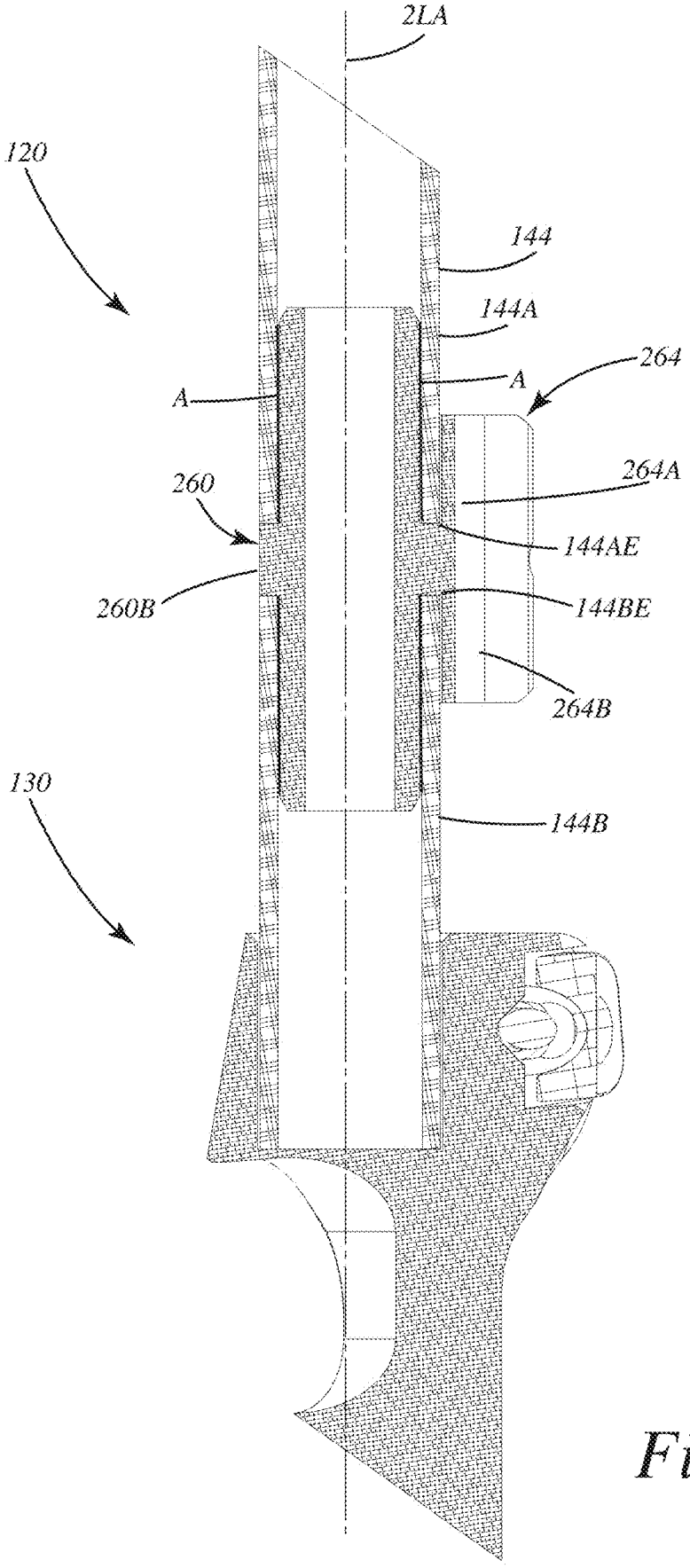
FIG. 22 is a section view taken along lines XXII-XXII of FIG. 21 showing the other connector lug with the external mount of the first alternative embodiment.

An alternative construction for a connector lug is shown in FIGS. 21 and 22 and designated 260. This connector lug can be identical to the connector lug 160 described above in structure, function, and operation, with several exceptions. For example, the connecter lug 260 can include male portions that extend into upper and lower tube portions 144A and 144B of a second upper primary riser tube 144 of the riser 120. This connector lug 260 also can include a connector band 260B that is disposed between the ends or edges 144AE, 144BE of those tube portions 144A and 144B. In this configuration however, the connector lug 260 can include mount 264 that is joined with the band 260B and which extends in an external manner over one or more exterior surfaces of the tube portions 144A and 144B. The mount to 264 can include a first mount portion 264A and a second mount portion 264B. The first portion 264A can extend in a cantilevered manner over the first tube portion 144A, and the second mount portion 264B can extend in an opposite direction, generally over the second tube portion 144B also in a cantilevered manner. The two portions can be joined together and can form a mounting plate, a picatinny rail and/or a dove tail rail to mount an archery accessory with a corresponding feature thereto and thus to the riser. As shown, the mount 264 is in the form of a picatinny rail. The mount 264 can conceal a portion of the edge 144AE of the first tube portion 144A, as well as a portion of the edge 144BE of the second tube portion 144B.

Optionally the mount 264 can subtend a certain angle A7 about the circumference of the band, the linear axis 2LA, and/or around the respective tube portions. The angle A7 can be optionally about 1 degree to 180 degrees, inclusive, about 1 degree to 120 degrees, inclusive, about 1 degree to 90 degrees inclusive, or other angles, depending on the structure of the mount. Although not shown, the mount alternatively can be a block or flange and can be tapped to include one or more thread holes. As shown in FIGS. 7, 8 and 21, the mount 264 can face forward and can be mounted on the second upper primary riser tube 144. Further, the mount 264 can be placed closer to the riser handle 130 than to the upper strut 152 to accommodate an archery sight. In some cases, the mount 264 can be a distance D8 from the shelf to accommodate an archery sight. This distance D8 can be optionally about 1 inch to about 11 inches, inclusive, about 1 inch to about 11 inches, inclusive, about 1 inch to about 10 inches, inclusive, about 2 inches to about 8 inches, inclusive, about 4 inches to about 8 inches, inclusive, or other distances depending on the application.

Further optionally, the mount 264 can be rotated and set or secured in a variety of different orientations relative to the tube and riser in general. As an example, the mount 264 might project laterally to the right of the riser, laterally to the left of the riser come up forward or rearward relative to the riser or in any angles between those positions relative to the riser. The respective picatinny mount or dovetail thus likewise can projecting these different orientations and directions relative to the riser. Moreover, as mentioned above, the connector lug and thus the mount can be installed relative to any of the riser tubes anywhere along the lengths thereof. Respective tube portions can be secured to the connector lug above and below that component and cut to the exact dimension and/or length to fit the riser. Regarding the length of the riser and/or the overall axle to axle length, it is noted here that the length can be infinitely customized to the preferences of a user. For example, where the primary riser tubes are constructed from composite tubes, those tubes can be custom cut to provide a specific length riser or axle to axle length. The same struts, riser handle, limbs and other components can be used with a variety of different length riser tubes, again which can be custom cut depending on the preference of the user of the finished bow.

A method of making and or assembling the archery bow of the current embodiments will now be described with general reference to FIGS. 7-21. As noted above, the current embodiments can reduce the complexity of riser assembly and manufacture via the primary riser tubes. As mentioned, these primary riser tubes can be various types of round tubes, having cylindrical, elliptical, rounded polygonal or other shapes. These tubes can come in stock dimensions, having particular lengths, diameters, wall thicknesses, strengths, etc. These tubes can be cut to any length. Where the archery bow is to be customized, with a particular riser length and/or axle to axle length, the tubes can be precisely cut before assembly of the bow to the preference or instruction of a user. For example, the user can specify a 30 inch axle to axle length, a 33 axle to axle length, a 36 inch axle to axle length, or some length between any of those lengths or outside those lengths. From there, a manufacturer can cut the tubes to a length that satisfies the specified axle to axle length requested by the user. This in turn can set the overall length of the riser to achieve that axle to axle length. The bow can then be set up with respective limbs, bow string and power cables specific to that particular axle to axle length. As will be appreciated, this type of customization can be much simpler than attempts at customization using conventional molded riser manufacturing, which requires the construction and assembly of very specific molds to mold a riser from a material in a specific configuration that is properly scaled. In contrast, the primary riser tubes of the current embodiments provide easy, instant and efficient customization.

In addition to cutting the respective lengths of the upper and lower primary riser tubes, the various other components can be constructed. For example, the riser handle, the first limb strut and the second limb strut can be molded, machined, 3D printed, or otherwise manufactured, optionally from a metal such as those metals described herein. These components can include the various features including the ports, vents, mounts or other structures as described herein.

As mentioned above, the respective riser handle and struts can include respective ports configured to receive the upper and or lower primary riser tubes where included. The respective ends of the riser tubes can be installed in the riser ports, for example on the riser handle. In particular, the first and second upper primary riser tubes 143 and 144 and first and second lower primary riser tubes 141 and 142 can be installed in the riser handle upper ports 181, 182 and riser handle lower ports 183, 184. Where an adhesive A is used to bond the tubes to the respective riser handle ports, the adhesive can be installed before plugging the ends of the primary riser tubes into the respective ports. Where a mass reducing recess or other feature shown in FIGS. 13-16 is included on the side walls of the ports and/or on the primary riser tubes, the adhesive can be applied over those recesses and/or can otherwise fill those recesses when the ends of the tubes are inserted into the riser handle.

Optionally, where the ports include one or more vents, air or other fluid in the ports or inside the tubes or in the gap G1, G2 between the tubes and the side walls of the ports can be expelled out through or evacuate the ports via the vents. Further optionally this can prevent and/or impair the adhesive from evacuating or seeping out from the gap between the primary riser tubes and the ports. In turn, this can provide a stronger chemical and physical bond between the primary riser tubes and the respective ports.

Where the primary riser tubes include any type of connector lugs 160, 260 described herein, those lugs can be installed between respective tube portions of a particular primary riser tube, as shown in FIGS. 18-22. The various male parts of the connector lug can be installed relative to those tube portions and adhered to the inside or some other portion of those tube portions.

As explained above, the primary riser tubes can be installed relative to the riser handle. During and/or after this installation relative to the primary riser handle, the opposing ends of each of the respective primary riser tubes, that is, the upper and lower riser tubes can be installed, inserted and/or plugged in the respective ports of the first limb strut and second limb strut. These ends optionally can be coated with an adhesive or other bonding agent. Moreover, the respective ends of the tubes and/or the ports can include the optional mass reducing features to enhance the physical bonding and interlock of the tubes relative to the ports. Of course, where the limb struts include vents, air can escape from the interior of the tube or from within the adhesive through the vents. In some cases, when an opposing end of a primary riser tube is already installed in a port, and another end is installed in another port, for example, in a limb strut, the air inside the port and/or the interior of that riser tube can be compressed and raised to greater pressure than ambient atmospheric pressure. Due to an optional vent however, the air can be expelled or released from the port as the tube and is installed in the port. Thus, the pressure can be normalized or equalized with the external environment pressure through the vent allowing air to escape through it, rather than through the gap between the tube and the port sidewall. Adhesive between the exterior of the tube and the interior of the port sidewall thus is less likely to be pushed out by such air because the pressure can be released via the vent, rather than through the gap to move or ooze the adhesive out from that gap. Location of the vent at near the bottom of the port or bore also can allow more of the air to escape before the end of the tube fully or partially obstructs the vent during installation of the tube in the port.

After the primary riser tubes are installed relative to the limb struts and the adhesive (if included) cures, the limbs can be installed relative to the limb struts, and cams can be installed relative to the limbs. The bow string and any respective power cables can be installed relative to the cams. A flexing cable guard and or bowstring stop also can be installed relative to the riser handle. Where an archery accessory, such as an arrow rest, sight, quiver, stabilizer and the like are included on the bow, those components can be attached to the respective connector lugs and/or portions of the riser handle and or limb struts as described herein.

The following additional statements are provided, the numbering of which is not to be construed as designating levels of importance.

Statement 1. An archery bow comprising: a first limb and a second limb joined with a riser comprising: a riser handle; an upper primary riser tube including a first linear axis; and a lower primary riser tube including a second linear axis; wherein the upper primary riser tube and the lower primary riser tube terminate at the riser handle without being connected to one another.

Statement 2: The archery bow of Statement 1, wherein the riser handle is constricted from metal, wherein the upper primary riser tube and the lower primary riser tube are constructed from straight carbon composite tubes, each having a round cross section.

Statement 3: The archery bow of any preceding Statement, wherein riser includes an upper strut joined with the first limb and a lower strut joined with the lower limb, wherein the upper strut and lower strut are constructed from metal.

Statement 4: The archery bow of any preceding Statement, wherein the upper riser tube is located only between the upper strut and the riser handle, wherein the lower riser tube is located only between the lower strut and the riser handle.

Statement 5: The archery bow of any preceding Statement, wherein no upper riser tube extends below the riser handle, wherein no lower riser handle extends above the riser handle, wherein the upper riser tube and lower riser tube terminate at ends that are distal from one another with the riser handle therebetween.

Statement 6: The archery bow of any preceding Statement, wherein at least one of the riser handle, the upper strut and the lower strut includes a port, wherein the upper riser tube or lower riser tube is plugged into the port, wherein the port is surrounded by a port sidewall of the same shape as the tube.

Statement 7: The archery bow of any preceding Statement, wherein the port defines a vent, wherein the vent is in fluid communication with a gap defined between the tube and the port sidewall to allow air to escape the gap.

Statement 8: The archery bow of any preceding Statement, comprising a connector lug, wherein the connector lug includes a band engages with respective tube portions above and below the band, wherein the connector lug is adhered to the respective tube portions.

Statement 9: The archery bow of any preceding Statement, wherein the band includes at least one of a mount and a fastener hole configured to mount an archery accessory to the riser tube.

Statement 10: The archery bow of any preceding Statement, wherein the band includes shoulders that engage circular edges of the tube portions.

Statement 11: The archery bow of any preceding Statement, wherein the connector lug includes opposing male portions disposed within an inner diameter of each of the respective tube portions.

Statement 12: The archery bow of any preceding Statement, wherein the riser handle includes at least one of a cable guard and a bowstring stop, projecting rearward from the a grip of the riser handle.

Statement 13: The archery bow of any preceding Statement, wherein the riser handle is constructed from metal, wherein the bowstring stop comprises a bar, wherein the bar is installed in a mount hole defined by the riser handle.

Statement 14: The archery bow of any preceding Statement, wherein the riser handle includes a shelf, wherein the cable guard is joined to the riser handle above the shelf, wherein the cable guard is not connected to any riser tube of the archery bow.

Statement 15: The archery bow of any preceding Statement, wherein the riser handle, upper strut and lower strut each include respective ports into which the respective upper and lower primary riser tubes are plugged and adhered, wherein the upper strut is joined with a limb pocket distal from and disconnected from the upper riser tube.

Statement 16: A method of making an archery bow or riser comprising: providing a riser handle including a first port bounded by a first sidewall and a first limb strut including a second port bounded by a second sidewall; cutting a round tube to produce a primary riser tube having a hollow space extending therethrough; installing the primary riser tube in the first port and the second port to join the riser handle and the limb strut.

Statement 17: The method of Statement 16 comprising applying an adhesive to a first end and a second end of the primary riser tube and bonding the first end to the first sidewall and the second end to the second sidewall with the adhesive.

Statement 18: The method of any preceding Statement comprising providing a vent in at least one of the first port and the second vent to provide fluid communication between a gap between the primary riser tube and a port sidewall so that a gas in the adhesive can escape the adhesive and/or the gap.

Statement 19: The method of any preceding Statement comprising pushing the first end into the first port first, then pushing the second end into the second port later; joining a limb to the first strut; joining a cam to the limb; and joining a bowstring to the cam.

Statement 20: The method of any preceding Statement comprising cutting a primary riser tube to a first predetermined length to provide a custom axle to axle length of the archery bow for a user.

Statement 21: The method of any preceding Statement comprising installing a connector lug relative to a first tube portion and a second tube portion of the primary riser tube before installing the primary riser tube in the first port and the second port.

Statement 22: The method of any preceding Statement comprising adhering at least one of a male part and a female part to the first tube portion and the second tube portion before installing the primary riser tube.

Statement 23: The method of any preceding Statement wherein the connector lug includes at least one of a fastener aperture to join an archery accessory to the primary riser tube and a dovetail or picatinny mount extending outward from the connector lug, optionally overlapping at least one of the first tube portion and the second tube portion.

Statement 24: The method of any preceding Statement wherein the vent is a cylindrical hole extending from an interior surface of the sidewall to an exterior surface of the port, or a hole extending through a sidewall of the primary riser tube, or a recess extending around an edge of the riser tube to provide fluid communication between the gap and the environment or the interior of the primary riser tube respectively.

Statement 25: The method of any preceding Statement wherein air inside the primary riser tube, first port and/or second port is expelled through the vent as the primary riser tube is installed relative to the first port or the second port.

Statement 26: The method of any preceding Statement comprising installing another riser tube below the riser handle and joining the other riser tube with a a second strut, joined with another limb and another cam.

Statement 27: An archery bow comprising: a first limb; a second limb distal from the first limb; a bowstring extending between the first limb and the second limb and moveable within a bowstring plane; a riser joined with the first limb and the second limb, the riser comprising: a riser handle; a first upper primary elongated element, in the form of at least one of a hollow tube, a solid bar, and a solid rod, the first upper elongated element including an upper, straight, linear axis extending upward from the riser handle; and a first lower elongated element including a lower, straight linear axis extending downward from the riser handle, wherein the upper, straight, linear axis and the lower, straight, linear axis are parallel.

Statement 28: The archery bow of any preceding Statement, wherein the first upper elongated element extends to a lower end that terminates adjacent the riser handle, the lower end having a lower edge disposed in an upper riser handle port, wherein the first lower elongated element extends to an upper end that terminates adjacent the riser handle, the upper end having an upper edge disposed in a lower riser handle port.

Statement 29: The archery bow of any preceding Statement, wherein the first upper elongated element and the first lower elongated element are each elongated, straight, cylindrical tubes, bars and/or rods constructed from at least one of metal, carbon composite and plastic, wherein the riser handle is constructed from metal.

Statement 30: The archery bow of any preceding Statement, wherein the riser handle defines a first upper handle port surrounded by a first port sidewall of the riser handle, wherein a gap is disposed between the first upper elongated element and the first port sidewall, wherein the first upper handle port includes a first vent through which a fluid in the gap between the first upper elongated element and the first port sidewall travels to exit the gap.

Statement 31: The archery bow of any preceding Statement, wherein the first upper elongated element is secured in a first upper handle port of the riser handle with an adhesive disposed between the first upper elongated element and a first port sidewall of the first upper handle port, wherein at least one of the first upper primary riser tube and a first port sidewall of the first upper handle port defines a mass reducing recess, whereby the adhesive extends into the mass reducing recess to enhance a mechanical bond between the first upper elongated element and the first upper handle port.

Statement 32: The archery bow of any preceding Statement, a connector lug disposed between the first limb and the riser handle, wherein the first upper elongated element includes a first upper portion and a first lower portion, wherein the connector lug is disposed at least one of in an interior and around an exterior of the first upper portion and the first lower portion with an exposed portion located between the first upper portion and the first lower portion, wherein the connector lug is constructed from the first material which is metal, wherein the connector lug includes a connector configured to secure an archery accessory to the first upper elongated element.

It will be appreciated that by identifying or naming herein certain elements as first, second, third, etc., that does not require that there always be a certain number of elements preceding, succeeding, above, below, adjacent and/or near the numbered elements. Further, any one of a numbered group of elements, for example, a third element, alternatively can be referred to as a first, second, fourth or other numbered elements. The same is true for the naming of any other elements in the form of a first element, second element, third element, etc., as used herein.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because a component, element or assembly is described herein as having a function does not mean its orientation, layout or configuration is not purely aesthetic and ornamental in nature.

Although the present description includes different embodiments, it will be appreciated that various elements, features, parts, components, assemblies, orientations, functions and operations of one embodiment can be mixed and matched with one or more other embodiments. For example, one or more elements, features, parts, components, assemblies, orientations, functions and operations of one embodiment can be readily combined with another embodiment, or several other embodiments piecemeal, which combination is fully contemplated and hereby disclosed.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A method of making an archery bow or riser comprising:

providing a riser handle including a first port bounded by a first sidewall and a first bottom, and a first limb strut including a second port bounded by a second sidewall;

providing a round primary riser elongated element;

applying an adhesive to at least one of the primary riser elongated element and the first port;

installing the round primary riser elongated element in the first port and the second port to join the riser handle and the first limb strut, without the primary riser elongated element extending past the riser handle and the first bottom;

providing a vent in at least one of the first port and the second port to provide fluid communication so that a gas can escape at least one of the adhesive, the first port, the second port, and the primary riser elongated element; and allowing the adhesive to cure.

2. The method of claim 1 comprising:

applying the adhesive to a first end and a second end of the round primary elongated element; and bonding the first end to the first sidewall and the second end to the second sidewall with the adhesive, wherein the adhesive is a glue.

3. The method of claim 1 comprising:

providing the primary riser elongated element with a first end and a second end;

pushing the first end into the first port so that the first end is adjacent the first bottom, without extending beyond the first bottom of the first port, and without extending below the riser handle;

pushing the second end into the second port;

joining a limb to the first limb strut;

joining a cam to the limb; and joining a bowstring to the cam.

4. The method of claim 1 comprising:

allowing the adhesive to seep between the primary riser elongated element and the first sidewall to fill a gap which is located between the first sidewall and an exterior elongated element surface of the primary riser elongated element.

5. The method of claim 1 comprising:

compressing the gas inside the primary riser elongated element to form pressurized gas; and expelling the pressurized gas out the vent.

6. The method of claim 1, wherein the primary riser elongated element is a first linear, round carbon tube, wherein the first port is an upper port defined by the riser handle above a riser shelf, wherein a third port is a lower port defined by the riser handle below the riser shelf and distal from the upper port, wherein the upper port includes the first bottom, which is a first closed bottom, wherein the lower port includes a second bottom, which is a second closed bottom, wherein the upper port and the lower port are separate and distal from one another.

7. The method of claim 6, comprising:

inserting a second, linear round carbon tube inside the lower port toward the second closed bottom, wherein the first, linear, round carbon tube engages the first closed bottom, wherein the second, linear, round carbon tube engages the second closed bottom.

8. The method of claim 1, comprising:

installing the round primary riser elongated element into the first port; and bottoming out the round primary riser elongated element against the first bottom so the primary riser elongated element cannot extend beyond the riser handle.

9. The method of claim 1, wherein the round primary riser elongated element is a carbon tube that is linear and of a circular cross section, having a first end ending at the limb strut and a second end ending at the riser handle, wherein the carbon tube includes a linear axis that extends from the first end to the second end with no curvature to the linear axis.

10. A method of making an archery bow or riser comprising:

providing a riser handle including a first port bounded by a first sidewall and a first limb strut including a second port bounded by a second sidewall;

providing an upper carbon tube having a round cross section and a first end ending at the limb strut and a second end ending at the riser handle, the upper carbon tube including a first linear axis that extends from the first end to the second end with no curvature to the first linear axis;

applying an adhesive to at least one of the upper carbon tube, the first port and the second port; and installing the upper carbon tube relative to the first port and the second port to join the riser handle and the first limb strut, without the upper carbon tube extending past the riser handle, wherein the adhesive is disposed in a gap between the first sidewall and an exterior of the upper carbon tube disposed in the first port.

11. The method of claim 10 comprising:

curing the adhesive.

12. The method of claim 10 comprising:

pushing the upper carbon tube against a first bottom wall of the first port to cease installing the upper carbon tube into the first port.

13. The method of claim 10 comprising:

pressurizing air inside the upper carbon tube to form pressurized air; and venting the pressurized air out a vent defined by at least one of the first port, the second port and the upper carbon tube.

14. The method of claim 10 comprising:

allowing the adhesive to seep out the gap, above the first port.

15. The method of claim 10 comprising:

installing a lower carbon tube relative to the riser handle below the upper carbon tube, without the lower carbon tube extending upward past the riser handle, the lower carbon tube including a second linear axis that extends throughout the lower carbon tube with no curvature to the second linear axis, wherein the first linear axis and the second linear axis are aligned and parallel with one another.

16. The method of claim 10 comprising:

installing the upper carbon tube into the first port; and bottoming out the upper carbon tube against a portion of the first port so that the upper carbon tube cannot extend beyond the first port and the riser handle.

17. A method of making an archery bow or riser comprising:

providing a riser handle including a first port bounded by a first sidewall and a first bottom, and a first limb strut including a second port bounded by a second sidewall;

providing a straight carbon tube including a first linear axis that extends from a first end to a second end of the straight carbon tube with no curvature to the first linear axis; and installing the straight carbon tube relative to the first port and the second port to join the riser handle and the first limb strut, without the straight carbon tube extending past the riser handle and the first bottom, wherein an adhesive moves within a gap defined between the first port and the straight carbon tube during the installing.

18. The method of claim 17 comprising:

allowing the adhesive to secure and thereby bond the straight carbon tube to the first port.

19. The method of claim 18 comprising:

inserting the straight carbon tube within the first port during the installing and bottoming the straight carbon tube out against the first bottom whereby the inserting ceases.

20. The method of claim 17 comprising:

providing another straight carbon tube including a third linear axis with no curvature to the third linear axis; and installing the other straight carbon tube relative to a third port defined by the riser handle under the first port, the third port being separate and distal from the first port, the third port including a third bottom, without the straight carbon tube extending past the riser handle and the third bottom, wherein the other straight carbon tube projects downward from the riser handle.

* * * * *